United States Patent [19]

Colgate

[11] Patent Number: 4,490,974

[45] Date of Patent: Jan. 1, 1985

[54] ISOTHERMAL POSITIVE DISPLACEMENT MACHINERY

[75] Inventor: Stirling A. Colgate, Los Alamos, N. Mex.

[73] Assignee: Colgate Thermodynamics Co., Princeton, N.J.

[21] Appl. No.: 414,550

[22] Filed: Sep. 8, 1982

Related U.S. Application Data

[63] Continuation-in-part of Ser. No. 302,254, Sep. 14, 1981, abandoned.

[51] Int. Cl.[3] ..... F02G 1/04

[52] U.S. Cl. ..... 60/520; 60/517; 62/6

[58] Field of Search ..... 60/516, 517, 520, 526; 62/6

[56] References Cited

U.S. PATENT DOCUMENTS

| | | | |
|---|---|---|---|
| 2,989,281 | 6/1961 | Fritts | 60/516 X |
| 3,530,681 | 9/1970 | Dehne | 60/526 |
| 3,827,675 | 8/1974 | Schuman | 60/517 X |
| 4,309,872 | 1/1982 | Raser et al. | 60/516 |

*Primary Examiner*—Allen M. Ostrager
*Attorney, Agent, or Firm*—Brumbaugh, Graves, Donohue & Raymond

[57] ABSTRACT

Positive displacement isothermal gas cycle machinery is designed with explicit control of the heat flow between the gas, the walls of the chamber and a thermal reservoir externally of the chamber. The control is achieved by providing a large chamber wall area to chamber volume ratio through the use of bellows-like walls having a configuration that ensures during each stroke numerous heat exchanges between the working gas and the bellows-like walls. The machinery includes Stirling cycle heat pumps and motors and isothermal compressors. Significant gains in thermal efficiency, up to a factor of 2, are attainable because the largest inefficiency in all isothermal machinery is imperfect control of heat flow. A regenerator for the isothermal machinery minimizes cycle losses due to gas transfer friction, gas thermal conduction, dead volume, regenerator heat mass, regenerator heat mass thermal skin depth, and regenerator mass thermal conductivity in the gas flow direction.

25 Claims, 14 Drawing Figures

BELLOWS HEAT PUMP WITH CRANKSHAFT DRIVE

DELTA T/T = 0.54
PHASE ANGLE = 120°

DELTA T/T = 0.54
PHASE ANGLE = 90°

BELLOWS HEAT PUMP
WITH CRANKSHAFT DRIVE

BELLOWS FREE PISTON HEAT PUMP WITH LINEAR INDUCTION MOTOR DRIVE

BELLOWS FREE PISTON HEAT PUMP WITH
STERLING CYCLE ENGINE DRIVE

BELLOWS ISOTHERMAL HEAT ENGINE

ISOTHERMAL POSITIVE DISPLACEMENT MACHINERY

This application is a continuation-in-part of U.S. patent application Ser. No. 302,254, filed Sept. 14, 1981 now abandoned.

BACKGROUND OF THE INVENTION

Introduction

There are in general two types of machinery used either to do work on or to have work done by the compression or expansion of gases. These two generic types of machinery are positive displacement and turbine. The positive displacement type includes various mechanically driven or driving pistons or vane type rotors. A volume of gas is carried at relatively low velocity from one volume to a different one, either larger or smaller depending upon the function of compressor or engine. In the other type of machinery, turbines, the gas flow through blades occurs at a velocity of roughly the speed of sound of the gas. It is well known to those designing such machinery that the turbines can be made more efficient than positive displacement machinery. The reason for this difference in efficiency has frequently been obscure. A knowledge of the source of this inefficiency will allow positive displacement machinery to be designed in a fashion such that the inefficiency or loss is reduced by a significant factor to a minimal value. There is, of course, the well-recognized, additional loss of energy in positive displacement machinery due to the friction between whatever is the displacer, piston or vanes, and the walls of the chamber. The turbine in turn avoids this inefficiency but has others such as the friction of aerodynamic flow at velocities near the sound speed.

Heat Exchange and Total Energy Loss

Frictional loss between sliding parts is important, but not usually the principal energy loss in the system. However, I will focus on one property of positive displacement machinery that does cause a major inefficiency and that is not well understood. This is the heat exchange between the gases being compressed or expanded and the walls of the positive displacement volume. This heat exchange is usually accepted as fundamental. Instead, I claim it can be significantly reduced or enhanced as best suits the purpose of the machinery, reduced in the case of adiabatic cycles, and enhanced in the case of isothermal cycles.

Heat Exchange With the Walls

Let us consider first compressors, although these comments can be equally applied to expansion engines with an inversion of terms. If a gas is adiabatically compressed, it becomes both hotter as a function of compression as well as increased in pressure. The increase in temperature and pressure follow the well known relations of the adiabatic law. In some cases, as in a gas compressor, the additional temperature created in the gas is later rejected as a nuisance, although a significant fraction, even a major fraction, of the useful work may be wasted in the rejection of this heat. In any gas compressor, where this heat is rejected, it is more efficient to reject this heat as early in the cycle as possible so that less work is done achieving a desired volume of cooler compressed gas. In other cases where a compressor is used, as in a Rankine cycle heat pump or in a compression cycle of various internal combustion engines, e.g. supercharging this departure from an adiabatic compression due to heat exchange of the working fluid, i.e. gas, with the walls of the compressor is a major disadvantage and inefficiency of the system. A point of my related invention, the subject of U.S. patent application Ser. No. 302,167, filed Sept. 14, 1981, is that by proper design of the input and output ports of adiabatic positive displacement machinery this heat exchange can be reduced to a small value.

The mechanism for this heat loss is turbulent motion of the working fluid making contact with the walls during compression or expansion. There are two parts to this heat exchange: (1) the heat exchange between the gas and the wall if the wall were held isothermal, and (2) the heat impedance of the wall itself. It turns out that the heat impedance of the wall is such that the wall acts as a time lag averaging reservoir coming to a temperature equal to the mean temperature of the gas at a delayed phase of the stroke. The time phase lag as well as the magnitude of heat exchange are both detrimental to adiabatic efficiency.

Thermal Skin Depth

One can calculate the heat mass of the wall during the transient contact with the gas by calculating the thermal skin depth within the time of heat contact. The thermal skin depth, d, of penetration of heat (or cold) within the given time t is expressed mathematically as $$d=[(K/C_V)t]^{\frac{1}{2}}$$

where $C_V$ is the specific heat of the wall material, K is thermal conductivity, and t is the time. $(K/C_V)$ is often called the diffusion coefficient. For typical materials where $C_V$ is 1 calorie $cm^{-3}$ $deg^{-1}$, and the time $=10^{-2}$ sec (for a stroke at 3000 RPM) or longer, the skin depth will vary between $3\times10^{-3}$ cm for a plastic with $K=10^{-3}$ cal $cm^{-3}$ $deg^{-1}$ at the highest speed to $3\times10^{-2}$ cm for a metal and a large slow piston. Even the smallest skin depth corresponds to a heat mass equivalent to several centimeters of air or freon at atmospheric pressure. Therefore the heat mass of the skin depth of the wall in contact with the gas will be comparable to or larger than the heat mass of the gas. It is usual in engineering practice to neglect this skin depth factor and assume that the wall takes on a temperature which is the time average of the heat flow from the gas. In this case the primary factor in determining heat loss is the theoretical heat exchange of the gas with an assumed isothermal wall almost independent of wall properties. Later I will show the importance of the time dependent phase lag of the heat flow. First I will demonstrate the skin depth effect. We assume that the walls of the chamber will be smooth and then the heat loss will be governed by the turbulent flow exchange with a smooth wall.

Explantation of Diffusive Heat Flow

In FIG. 1 I show the classic solution of the diffusion of heat from one reservoir 1 into a second reservoir 2. Let us assume that 1 is hotter at $T_1$ and is a turbulent gas with essentially infinite ability to transport heat up to a barrier 3. The heat diffuses into, or out of, region 2 with a diffusivity $K/C_V$. Then the distribution of heat or temperature, T, as a function of depth, x, follows a sequence of "error function" solutions in which $$T=T_2+(T_1-T_2)\exp(-x^2/d^2)$$

or $$T=T_2+(T_1-T_2)e(-x^2/d^2)$$

where as before $$d=[(K/C_V)t]^{\frac{1}{2}}$$

The distance d is the centroid of the depth of penetration of the thermal wave. The three curves labeled $d_1$, $d_2$, $d_3$ are the temperature profiles of times $t_1$, $t_2$, $t_3$, where $t_1$ is less than $t_2$, is less than $t_3$, with characteristic skin depths $d_1$ being less than $d_2$ being less than $d_3$. If $T_1$ is time dependent as it would be in a cylinder with alternatively hot or cold gases, then the actual distribution of temperature should be a simple addition of such solutions. In this sense "cold", i.e. $T_1$ is less than $T_2$, can penetrate into the wall just as well as hot, $T_1$ is greater than $T_2$. The skin depth is just the characteristic averaging depth of each temperature variation in a time t. The heat mass described by each curve is $H=d(T_1-T_2)C_V$ and hence the longer the time the heat has to "soak" in, the greater the heat transferred. Typical diffusivities and skin depth heat masses are shown in Table 1 for various materials. A frequency of 3000 RPM is chosen as an example and the skin depth heat mass is compared to 8:1 compressed combustion gases typical of an Otto cycle engine. The diffusive properties of air without turbulence are added for comparison. One can see that the purely diffusive heat flow in air leads to a skin depth heat mass that is very small, $10^{-3}$ of that of the wall. Therefore for the wall heat mass to be important requires augmentation of the gas heat flow by turbulence.

TABLE 1

Diffusivity, skin depth, heat mass of various materials assume 3000 RPM, t = 1/(2f) = 0.01 sec.

| | Thermal Conductivity Watts/cm²/deg C/cm | Heat Capacity Cal cm⁻³/deg C/cm | Diffusivity $D/C_V$ cm² sec⁻¹ | Heat mass of skin depth $C_V(Dt)^{\frac{1}{2}}$ cal cm⁻² |
|---|---|---|---|---|
| Carbon Steel | 0.5 | 0.81 | 0.13 | 0.0164 |
| Stainless Steel | 0.14 | 0.81 | 0.036 | 0.0087 |
| Nickle-Chrome | 0.11 | 0.81 | 0.028 | 0.0076 |
| Phosphorus Bronze | 2.2 | 0.84 | 0.55 | 0.035 |
| Berylilium Copper | 0.8 | 0.84 | 0.20 | 0.021 |
| Aluminum Alloy | 1.6 | 0.58 | 0.57 | 0.025 |
| Carbon Coke | 0.28 | 0.3 | 0.2 | 0.0075 |
| Aluminum Oxide Ceramic | 0.30 | 0.8 | 0.08 | 0.013 |
| Silicon Dioxide Fused | 0.016 | 0.8 | 0.004 | 0.003 |
| Air atmospheric | $2.3\times10^{-4}$ | $2.86\times10^{-4}$ | 0.19 | $1.25\times10^{-5}$ |
| Air 8 × atmospheric | $2.3\times10^{-4}$ | $2.3\times10^{-3}$ | 0.023 | $3.5\times10^{-5}$ |

The heat capacity of air plus fuel, eight-fold compressed $=5\times10^{-3}$ cal cm$^{-3}$ or roughly twice that of compressed air along. A volume defined by a cylinder and piston at maximum compression with average dimension of 1 cm will have a heat mass of the charge that is 30% of the heat mass of the thermal skin depth of the wall of carbon steel. If part of the wall is covered by an oil film or carbon black of lower diffusivity, this fraction will be larger. Thus a small part of the heat of either compresson or combustion delayed to the next period of compression or combustion can be significant. It will increase the energy of compression, and reduce the efficiency of the cycle.

Turbulent Heat Exchange With a Smooth Surface

If a gas flows in a smooth-wall pipe, then the properties of turbulent fluid heat exchange are such that the gas will reach thermal equilibrium with the wall after moving roughly 50 pipe diameters (American Handbook of Physics, 1963). This is also the viscous slowing down length, or the length in which kinetic energy is dissipated. The quantity "50 pipe diameters" is determined by the peculiar properties of the laminar sublayer. This is the boundary layer between turbulent fluid flow and smooth pipe wall. In the case of the cylinder or other compression volume the appropriate consideration is the distance the fluid (or gas) travels in contact with the wall during the time of a stroke. If the gas enters from a valve with a high velocity relative to the chamber, then the gas will circulate many times within the compression chamber during the time of a compression or expansion stroke. The number of cycles of circulation can be roughly estimated by the ratio of the velocity of the gases entering through the input valve to the velocity of the piston. The average ratio of the valve area to piston area is frequently about 20 to 1 (Taylor, 1966), so that gases entering the cylinder have velocities between 10 to 20 times that of the piston velocity. In general the gases enter the chamber nonsymmetrically with respect to the compression volume so that the turbulence generated by the flow will be greater than that induced in a normal pipe flow of a fluid moving through a pipe. Therefore the heat exchange with the wall will be greater when the turbulence is greater. We expect roughly e-fold of heat exchange within roughly 10 circulation times because the gas flowing by corners will be more turbulent than straight pipe flow. Therefore the typical piston with restricted inlet valves will allow heat exchange of the gas with the wall of roughly half the differential heat of the gas during the time of compression or expansion stroke. Since the differential temperature of the wall relative to the gas is roughly $\frac{1}{2}$ the total temperature difference, then roughly $\frac{1}{4}$ of the heat is lost to the wall. It is this large heat exchange which accounts for the primary inefficiency of such gas handling machines. The only way to avoid this heat loss is to allow the gases to enter the compression volume with low velocities. Then the distance the gas moves during a stroke is small (measured in diameters) and the heat exchange will be small. If the flow velocity of the entering gas carefully matches the velocity of the piston or other compression members, then we expect a weakly turbulent boundary layer, i.e. not perfect laminar flow but instead a low turbulence. The near absence of turbulence I call near-laminar flow and hence the crucial design is to create near-laminar flow of the input gas during the compression or expansion cycle. If the flow is to be near-laminar, at the piston velocity, then the inlet port area must be close to the full piston area. Or similarly, in an expansion engine, the inlet ports must again be equal to the piston area. This also applies to rotating vane machinery.

The Inefficiency Due to the Exchange of Heat of the Gas With the Wall in an Adiabatic Cycle Suppose a gas initially at temperature $T_1$ is compressed such that its final temperature would be $T_3$ if it were a perfect adiabatic compression but instead is held isothermally at an intermediate temperature $T_2$ during the latter part of compression. Then $T_1$ is less than $T_2$ is less than $T_3$, and then the heat energy in the gas after it leaves the piston will be less than it would be by the ratio $T_2/T_3$. (The mass of the gas is conserved). Therefore the inefficiency factor of an adiabatic cycle or the heat loss is just the difference $(T_3-T_2)$ divided by the heat that would have been in gas $(T_3-T_1)$. Depending upon the cooling of the cylinder walls and other factors $T_2$ might be only half way between $T_1$ and $T_3$, and therefore compression machinery would be 50% efficient in following an adiabatic compression. The temperature $T_2$ that the wall reaches will be a complicated function of the heat exchange process and the cooling of the walls. In general the gas will not come into equilibrium at every point in the stroke, and so only an approximation to this heat loss will actually occur. However, the fact that a simple calculation indicates that up to 50% of the theoretical maximum heat can be exchanged is sufficient reason to try to design machinery where one avoids this heat short circuit and its attendant loss in efficiency.

If the wall remained isothermal at temperature $T_2$, then this heat loss to the walls would be an actual advantage in a compressor as, for example, a refrigeration cycle or normal air compressor. However, the heat exchange of the gas to the wall is more complicated than this. If the gas can lose heat to the wall in part of the cycle it can also gain heat from the wall in another part of the cycle if the wall is hotter than the gas. The wall will be hotter than the gas for a transient time due to the skin depth effect. This latter effect of heating the gas from the wall is particularly harmful to the efficiency of the compressor because the heating of the gas occurs at its induction when the wall is hotter than the inlet gas. The gas is then compressed with higher heat than the ideal adiabatic cycle, and hence more work is required than would be required for the idealized cycle. Thus the heat is exchanged with a harmful phase lag. Let us illustrate these ideal cycles with and without heat exchange with the wall, FIG. 2.

The gas is drawn into the cylinder during the induction stroke starting at temperature $T_o$ along the constant pressure $P_o$ to the volume, $V_o$. In the ideal cycle it starts compression at volume, $V_o$ along the pure adiabatic curve 1, reaching the final reservoir pressure $P_1$ at volume $V_1$ and temperature $T_1$. Several possibilities due to heating the gas by the wall exist:

(1) If the gas is heated by $+T_{diff}$ only during induction, then the pressure-volume relation will remain the same. That is, since the gas is only heated by the walls during induction and not during compression, by assumption, the compression will be adiabatic (curve 1) and therefore will arrive at the same state $V_1$, $P_1$, but at a higher temperature $T=(T_{diff}+T_o)/T_o\times T_1$. The excess heat will be later rejected, therefore requiring more work to deliver the same mass of gas.

(2) Heat can be added after the start of compression and the gas will follow the curve 2, steeper than the pure adiabatic one. The gas temperature is then likely to exceed the wall temperature, transferring heat from the gas back to the wall and the curve will bend over, curve 3, less steep than the adiabatic curve 1. The work required will be greater. Curve 4 is more realistic in that wall cooling of the compressed gas at the end of the cycle may actually reduce the final gas temperature, $T_4$ at $V_4$, below $T_1$ at $V_1$ of the adiabatic case, but the net work still exceeds the adiabatic case.

(3) The wall can be cooled perfectly and retained at the temperature $T_o$, the gas can exchange heat with the wall perfectly and then the compression is isothermal along curve 5. This is the minimum work cycle to obtain cold gas at the final temperature $T_5=T_o$. It usually cannot be achieved in practice, again because (1) the skin depth argument that isolates the interior from the exterior on a transient basis, and (2) turbulent heat exchange is only partially effective in a normal cylinder and piston.

Summary of Heat Loss and Adiabatic Cycle

The heat exchange occurs because of turbulent flow in the induction gas. The maximum gas mass or minimum temperature $T_o$ is maintained during induction only if either the walls are retained at temperature $T_o$ or induction is near-laminar flow. During compression the same argument applies. However the thermal skin depth argument says that if the wall is thick compared to the skin depth, it will average the heat flow on the outside, but inside it will alternately be hot and then cold in a thin layer. If the gas is turbulent, this alternately hot and cold heat reservoir will cause heating of the induction air at the worst time, causing the compressed gas to reach a hotter temperature $T_3$ that in turn heats the gas still further and requires still more work, and so forth, until the higher average temperature of the walls allows the heat to be carried away. This is an inefficient compressor. It is better to reduce the heat exchange between the gas and walls by decreasing the turbulence and having near-laminar flow induction as well as compression.

Isothermal Compression

The opposite extreme of an adiabatic compression (or expansion) is an isothermal one where the heat is taken out (or introduced) continuously throughout the stroke. An engine cycle based upon this continuous heat exchange during both compression and expansion is called a Stirling cycle. The usual machinery, which employs a piston and a cylinder, designed for such a cycle has a difficulty similar to that of an adiabatic cycle, namely, heat diffusion in and out of the wall to a partial degree. In other words, only part of the gas heat is exchanged. In the isothermal case we want all the heat to be exchanged many times during the stroke. The two independent effects of the skin depth argument as well as the decay during the stroke of the inlet turbulence ensures a half-way result.

For an isothermal cycle we want (1) the thermal impedance of the wall to be small in order to conduct heat back and forth easily, and (2) we want the heat mass of the wall thermal skin depth to be large compared to the gas heat mass. In this fashion the inside wall temperature will remain isothermal, i.e., will average the temperature fluctuations and remain at the outside temperature.

Then the wall can be cooled or heated continuously and maintained both inside and outside at constant temperature. Then if the gas is maintained in close, thermal contact with the wall that bounds the compression or expansion volume during the stroke an isothermal compression or expansion process can be achieved.

The transient heat exchange due to partial turbulence and thermal skin depth is deleterious to all positive displacement heat machinery. As a useful measure Taylor (1966) ascribes about 30% efficiency loss to heat loss in a gasoline engine and up to 50% heat loss in a diesel engine. In other words a gasoline engine could be 45% efficient instead of 30% and a diesel could be 70% efficient rather than 35% to 40%. These are large potential gains and therefore warrant the following complexity to achieve these results. Conversely, Stirling cycles are particularly useful for heat pumps, and here the lack of effective heat transfer can make up to factors $\times 2$ difference in the performance of such machinery because both the compressor and the expander are affected by heat transfer.

GENERAL DESCRIPTION OF THE INVENTION

Isothermal Cycle Machines Generally

In an isothermal cycle, we want to exchange heat continously between the contained gas and a thermal reservoir. I have described above how the skin depth in the cylinder walls prevents the heat from penetrating to an external reservoir during part of a single stroke, and how the skin depth reservoir exchanges heat with the gas in the worst fashion for efficiency. Therefore if we wish to exchange the gas heat frequently during the cycle, both the thermal impedance of the heat of the gas to the wall as well as the thermal impedance of the heat through the wall must be made small. To achieve this result the surface to volume ratio must be made as large as possible, and in some cases the turbulence must be maximized.

The surface to volume ratio of a given geometric volume is minimum for a sphere or right circular cylinder whose length equals its diameter. This ratio is 3/radius for both geometries. In a sphere or right circular cylinder, the interior volume is a maximum distance from a wall. This is the ideal geometry for adiabatic cycles. In contrast, for isothermal cycles, I desire all fluid to be close to a wall so that the surface area is greatly increased compared to a right circular cylinder of equivalent volume. A factor of 10 increase in area is a minimum value and significantly larger ratios are possible and desirable for efficient isothermal machinery.

Bellows Compressor and Expander

To fulfill the above-described objectives, I provide, in accordance with my invention, a compressor-expander comprising a variable volume chamber defined by flexible, thin metal bellows side walls that are so configured as to ensure that all of the gas in the chamber is close to a metal wall and no mass of gas is remote from the wall and hence no volume of gas is quasi-adiabatic, but, instead, all the gas is isothermal in thermal contact with a metal wall. This is achieved by one of three bellows configurations. In one case the bellows are designed with a small inside radius, say from approximately 1/5 to 1/10 of the outside radius, so that the area of the hole and hence the inside volume is small (e.g. $1/25=4\%$ for a 1/5 ratio of inside to outside radius), of the outside area or convolution volume. In the second case a pair of nested bellows, one inside the other, is used as the compression-expansion volume. Here the annular space between the bellows is made small again to ensure that all gas is close to a metal heat transfer surface. In the third version, a single peripheral bellows with an inside radius of about $\frac{1}{3}$ to $\frac{2}{3}$ of the outside radius is fitted with baffles, one at each convolution, fastened into the seam between the discs. The baffles divide up the central space and provide close thermal contact with the central gas that is remote from the bellows and prevent the central gas from becoming adiabatic. Holes suitably arranged in the centers, the perimeters, or both, of each baffle in staggered positions baffle-to-baffle provide radial and circumferential flow patterns that better distribute the gas and promote heat transfer. The holes in the baffles are, of course, designed with a view to avoiding excessive, harmful gas flow friction.

The objective of the bellows design is to give a large surface area for heat exchange, create turbulence, have a thin wall for heat conduction and provide sufficient radial thermal conductivity to carry heat from within the chamber to the outside. Preferably, the ratio of bellows wall area to the area of a right circular cylinder of equivalent volume should not be less than 10:1. In addition, there are to be no large trapped volumes of gas that are near adiabatic, but instead all the gas is to remain isothermal in close contact with the walls. A cup type displacer inside the bellows that displaces the gas at the end of stroke is *not* sufficient; the extended stroke volume is large and not in contact with the walls and therefore is a major efficiency loss.

The heat must be transferred from the inside gas through the wall to the outside gas. The criterion of successful heat exchange is that the inside gas must remain isothermal during the time of compression or expansion and this temperature should be the same as that of the external reservoir of gas. Therefore thermal lag is the inverse of successful heat transport. There are several thermal lags:

(1) The transfer of heat from the internal gas to the metal bellows walls.

(2) The temperature drop through the metal wall.

(3) The external heat transfer to the reservoir from the metal walls.

The second thermal lag, number (2) above, is small and therefore will be discussed and eliminated first. For a bellows compressor or expander the surface area of the many convolutions of the walls is 50 to 100 times greater than for the same internal volume of gas in a normal cylinder. In a normal cylinder the ratio of the heat mass of the thermal skin depth to that of the internal gas is less than 10. The heat mass of the thermal skin depth of the bellows is very large, 100 to 1000 times, compared to the heat mass of the internal gas. Hence the small heat of the internal gas in a cycle does not significantly change the wall temperature, and the wall remains very nearly isothermal during a cycle. For the same reason the thermal lag of the metal bellows becomes negligible. The temperature difference of the two walls, inside and outside, can be calculated to be extremely small, less than 1° C. for useful size machinery. Then the major thermal lags are the heat transfer to the internal and external bellows surfaces.

The external heat transfer can be made large and hence the thermal lag small by inducing a high velocity flow of a fluid (usually air) around the external bellows surface. The external fluid can be exchanged many times in a convolution within a cycle time. This external surface naturally induces turbulence and high heat transfer. On the other hand the internal gas may not be as turbulent and hence will not exchange heat within a cycle as many times. However, the process of induction (and exhaust) of the gas introduces turbulence. The width to length ratio of the gas space between bellows convolutions is small and enhances heat transfer. Oscillations of the bellows can be introduced (they will occur naturally) during a stroke; this shuttles the internal gas from one end to the other during a stroke and induces a large turbulence and hence heat transfer. A combination of these effects results in a large heat transfer internally and hence small temperature lag and an efficient isothermal compressor (or expander).

The heat mass of the wall acts as an averaging thermal reservoir so that the external heat transfer can take place during the full cycle. To keep the temperature lag small, the ratio of the effective heat mass of the wall to the heat mass of the gas should be very large. The effective heat mass of the wall is the smallest of either the thickness or the thermal skin depth. Therefore, if the skin depth is larger than the wall thickness, the wall thickness becomes the wall heat mass. Mechanical considerations on the other hand like oscillating mass, spring constant and fatigue life indicate that a small wall thickness is desirable but limited by the stress induced by the gas pressure.

Stirling cycle heat pumps and motors use a pair of compressor-expanders interconnected via a regenerator. As described in more detail below, it is just as important in the case of the regenerator to minimize losses as it is in the compressor-expanders. Gas flow friction losses, the most important of the possible energy losses in the regenerator, should not exceed 3%. The regenerator should be designed to provide about 5 to 10 heat exchange lengths. The dead space of the regenerator should not exceed about one-fifth of the compressed volume of the working gas or about 10% of the displacement volume in order to minimize the reduction in the specific power.

SUMMARY OF THE INVENTION

The present invention is characterized in that the ratio of the surface area of the bellows-like walls of the variable volume chamber to the volume of the chamber and the configurations of the convolutions of the bellows-like walls are such as to ensure during each stroke numerous heat exchanges between the working gas in the chamber and the bellows-like walls by both laminar and turbulent heat transfer, thereby to ensure that heat is conducted to and through the bellows-like wall and thence to and from a thermal reservoir external to the bellows-like wall and to produce a substantially constant temperature cycle.

In the case of chambers having two flexible thin metal bellows-like walls, one nested within the other, defining an annular chamber, the bellows-like walls are closely spaced such that the chamber is substantially free of trapped volumes that are not in close diffusive turbulent thermal contact with one of the walls. In the case of a single peripheral bellows-like wall, the inside radius is from about one-third to about one-tenth of the outside radius and the inside central volume within the inside radius is small and in close diffusive turbulent thermal contact with the wall. Baffles connected to the bellows-like walls within each convolution and having holes to enhance the circulation of the working gas enhance the heat transfer between the gas and the wall.

The bellows are designed so that no mass of gas is ever more than a few millimeters (10 at most and ordinarily in the range of 2–5) from a wall surface. The maximum spacing, moreover, is proportional to the inverse of the square of the frequency [1/frequency$^2$] and the inverse of the initial pressure $P_i$. Hence the lower the operating frequency or the pressure, the further the maximum gas-wall spacing may be.

The bellows-like walls may comprise annular discs joined and sealed at each inside and outside edge to an adjacent disc, preferably by an elastomeric adhesive on the inside seams and by an elastomeric adhesive and a crimped channel at the outside seam.

The following further characteristics of invention are preferable:

1. The movable end walls of the compression and expansion chambers of heat pumps and motors are driven harmonically at a phase angle of from about 90° to about 120°. Such a drive may be imparted by a free piston positive displacement engine operating on an open Otto or diesel cycle, or by a linear electric motor.

2. A fluid is caused to flow through the external thermal reservoir and over the surface of the bellows-like walls externally of the chamber for enhancement of the heat transfer from the working gas to and through the bellows-like walls.

3. The ratio of the area of the bellows-like walls to the area of a right-circular cylinder of equivalent volume should not be less than about 10:1. In the case of bellows chambers having baffles, the ratio of the total area of the bellows walls and the baffles should likewise not be less than 10:1.

4. The heat mass of the thermal skin depth of the bellows-like wall is not less than about 100 times the heat mass of the working gas in the chamber.

5. The compression ratio of the machinery is of the order of 2:1 to 2.7:1, and preferably at the higher end of the range.

In machines having regenerators (required in heat pumps and motors) the dead volume of the regenerator is less than about 10% of the displacement volume of the heat pump or motor. The regenerator provides for about 5 to about 10 heat exchange lengths, and the heat mass of the metal in the regenerator is of the order of 10 to 20 times the heat mass of the working gas. Most importantly, the gas flow friction loss in the regenerator must not exceed about 3%.

Heat pumps and motors comprise two (2) isothermal units, each having a bellows compression chamber and a bellows expansion chamber. In these machines, the compression chamber and expansion chamber of the two units are mechanically coupled to move conjointly.

A compressor embodying the invention is characterized in that there is a single bellows compression-expansion chamber having a suitably driven end wall and having valved supply and exhaust ports in the other end wall.

An especially interesting machine is a low temperature difference Stirling cycle heat pump driven by a high temperature Stirling cycle engine powered by a hot gas, for example, exhaust from a burner, solar heat, or some other waste heat. Such a combination is referred to as a Veullimier cycle.

THEORY OF THE INVENTION

Stirling Cycle Heat Pump Theory

An isothermal heat pump or Stirling Engine has been the subject of considerable research endeavor, and yet the fact that such effort has resulted in only a small market penetration attests to the difficulty of the subject. The current state of the art is covered in the book *Stirling Cycle Machines,* 1973, reprint 1976, G. Walker, Clarendon Press, Oxford. There are, of course, some developments since then (one of which is mentioned below), but the prior art is best covered in the Walker book. (G. Walker's latest book, "Free Piston Stirling Engines," 1982, University of Calgary, Alberta, Canada, has been reviewed before publication and does not effect the following discussion.)

The well known Stirling cycle is composed of two isothermal functions, a compression and an expansion, and a reversible transfer process (the regenerator). The objective of this cycle is optimizing the energy efficiency and the specific power. These will always conflict. The practical use of such a cycle is as a heat pump for transferring heat, or equally as an engine for power. Generally heat pumps must work efficiently between relatively modest temperature differences, Delta T/T=10%, compared to engines that, depending upon materials and heat sources, will utilize Delta T/T=50%. Hence heat pumps are emphasized for commercial reasons where Delta T/T is small where Delta T is characteristic of heat pumps for domestic use, such as refrigeration, where Delta T is 30 degrees centigrade, and T is the absolute temperature, typically 300 degrees. As a consequence, efficiency becomes a major challenge. Just how serious small losses are is shown in the accompanying graphs (FIGS. 3 to 6 of the drawings).

Cycle Program

First the cycle program must be discussed. The phase relationship between the components of the Stirling cycle, compression; transfer; expansion; transfer, can be idealized where each process takes place separately. Indeed, the "rhombic drive" is a logical development to achieve this nearly full separation of cycle elements and presumably higher efficiency. However, the added complexity, the added friction loss, and most importantly the lack of time overlapping of the cycle functions make the idealized cycle drive less attractive than the simple "near" harmonic motion of a circular crank and crank rod. The lack of "time overlapping cycle function" is a subtle point that will be developed in greater detail later, but briefly the specific power of a given machine is limited in one part by the frequency. The efficiency in turn is effected non-linearly by, and is highly sensitive to, the gas friction loss in the transfer part of the cycle. To keep this to a minimum means using the major fraction of the cycle for transfer. This necessarily competes with the time required for heat transfer during compression or expansion. Hence in the harmonic cycle, these functions "overlap" in time, and for a loss of volumetric efficiency we gain in net specific power. On balance, the rhombic cycle is probably not worth the complexity. Hence this development will emphasize simple harmonic motion.

Before discussing efficiency the relative phase angle between the volumes must be understood.

The specific power of a given machine (isothermal cycle element) depends upon the work per cycle. This work is $$\text{Work} = P_i V_i (\ln C_R)$$

where $P_i$ is the initial pressure, $V_i$ is the initial volume, $(\ln C_R)$ is the natural logarithm of $C_R$, and $C_R$ is the compression ratio.

If the maximum pressure is limited by the strength of the materials, where $P_{max}[=C_R P_i]$ is a constant, then the specific power will be proportional to $(\ln C_R)/C_R$. This function is maximum for $C_R = e = 2.7$, a rather simple result. Nevertheless, with a limit on $P_{max}$ the dependence of specific power on $C_R$ is very weak, being for example 94% of maximum when $C_R = 2$. However, bellows, the essential element of this invention, are unlike the more common machine elements in that they are much stronger when compressed than when they are expanded. As a consequence, the limiting pressure becomes $P_i$, not $P_{max}$. In this case the specific power is proportional to $(\ln C_R)$ and is more sensitive to reductions in $C_R$. For example, $(\ln C_R) = 0.69$ when $C_R = 2$, a significant loss of specific power compared to 0.94 with the limit of $P_{max}$. As a consequence there is a significant motivation to maintain the compression ratio large like 2.7 fold.

Harmonic Phase Angle

The optimum phase angle with the inclusion of parameterized losses has been investigated. The usual investigation of phase angle (see Walker, supra., FIG. 5.4) shows an insensitivity to phase angle with no losses. When losses are included (see FIGS. 3 and 4 attached) for Delta T/T=0.54, $C_R = e = 2.72$, the relative useful work (intercept of the work curves with the right ordinate) for the two phase angles 120° and 90° is reduced by 28% for the case of no losses. The useful work for 90° phase angle is only 63% of the useful work for 120° phase angle when there is the small loss of 6%, i.e., a total cycle efficiency of 94%. Hence, the phase angle is important, provided one can obtain the small dead volume necessary for keeping $C_R = 2.7$. When the phase angle is 121° between compression and expansion, the allowable dead volume goes to zero if $C_R = 2.72 = e$.

Hence one finds a strong motivation to use a large phase angle with minimum dead volume.

Efficiency Losses

These same calculations of useful work are parameterized as a function of the overall individual cycle efficiency N. N is an efficiency parameter that expresses the fractional approach of the real expansion or compression process to a reversible isothermal process. The loss fraction $(1-N)$ is a measure of the mechanical work lost due to non-ideal processes in a full cycle. The extraordinary result of these calculations is the revelation of the extreme sensitivity of useful work of an isothermal cycle to such losses. We see in the case of Delta $T/T=0.54$, i.e., a hot engine, that the useful output work of such a cycle is reduced by a factor of 2 for a 120° phase angle and to 38% for a phase angle of 90° when the efficiency is 94%. In the case of a low temperature difference this sensitivity is further exaggerated. In FIGS. 5 and 6 the useful work for two temperature differences of Delta $T/T=15\%$ and Delta $T/T=10\%$ are shown for the two phase angles of 120° and 90°. Here a loss of about 2% (98% efficient) reduces the useful work to zero. If we are making a heat pump rather than an engine, this sensitivity to cycle loss means that the heating or cooling effect will require more energy than the equivalent ideal Carnot cycle. The conclusion is that irreversible cycle losses have a major effect on the useful work or on the work required to produce a given heat or cold as a heat pump.

I next make a distinction between mechanical and thermal losses. The cycle loss referred to above is a pressure loss and hence mechanical loss in the cycle. Mechanical friction losses in the machinery as well as gas friction loss in the regenerator transfer process are similarly direct cycle losses. Temperature loss, on the other hand, gives rise to cycle losses only in so far as the cycle pressure is effected. If a regenerator accepts gas at a temperature $T_1$ and returns it, say, cooler at $T_2$, then the heat corresponding to $T_1-T_2$ must be added to restore the gas to the original isothermal value $T_1$. The process of reheating the gas by the amount $T_1-T_2$ can be accomplished by either of two processes: (1) by PdV work, or (2) by additional heat flow from the reservoir at $T_1$. The mechanical work requires expensive mechanical energy, whereas the reheat from the reservoir is lower "quality" energy by the ratio of the overall thermal efficiency of the machine. For an isothermal cycle the gas must be in thermal contact with the walls or reservoir many times over, say 30 times, within a given stroke (compression or expansion) in order that the temperature and hence pressure not suffer a time phase lag and hence direct cycle loss of say 1/30 or 3%. Therefore, the thermal loss from the regenerator should be restored in a time of 1/30 of the compression or expansion stroke. Therefore the thermal cycle loss is less important than otherwise suspected.

This relative insensitivity of useful work to regenerator temperature lag is noted in Walker but not understood. The conclusion is that cycle losses in the compression expansion volume are more important than thermal loss in the regenerator by the ratio of (1/inefficiency) of the machine.

The several phases in the cycle that lead to direct cycle pressure loss are:

1. Mechanical friction of sliding parts.
2. Temperature lag due to lack of perfect thermal contact between the walls and gas during compression or expansion.
3. Pressure drop due to gas flow friction in the regenerator.

The first loss of sliding friction is obvious, and several Stirling cycle machines using bellows as the compression or expansion element just to reduce the friction of sliding parts have been proposed in the past. The second loss is the major loss in all Stirling cycle machines. It is due to a significant fraction of the gas behaving adiabatically during compression or expansion so that the gas temperature partially lags the reservoir temperature. If a volume of gas were perfectly adiabatic then the temperature variation during a stroke would be $$\text{Delta } T=T(1-C_r^{(\gamma-1)}).$$

If $C_R=2.72$, then Delta $T/T=50\%$ for air and 95% for helium. Hence in order for the temperature phase lag to be small the thermal contact with the walls must be excellent. This extreme sensitivity to trapped thermally isolated adiabatic volume of a gas is not generally recognized (Walker, 1973, 1976), and is ignored in most all Stirling engine disclosures. It is an object of this invention to reduce all thermally isolated volumes of gas to a very minimum and hence achieve high efficiency.

Finally the gas friction loss is more important in the regenerator than the temperature lag by the ratio (1/cycle efficiency), as has already been explained. This sensitivity to flow friction is not emphasized in the literature (Walker, 1973, 1976, Chapter 7) and hence the design of regenerators is uncertain and not complete. It is stated that "small engines work better with the regenerator entirely removed." A detailed analysis of why is not given. It is an objective of this invention to design the regenerator as a rational optimization of all the conflicting requirements.

Design and Heat Flow of Stirling Cycle Engines

In the limit of large dimensions and high velocity, i.e., high Reynold's number, heat flow in a gas takes place generally by turbulent transport. However, the distance of travel along and adjacent to a rough wall must be considerable —like 5 to 10 channel widths for one heat exchange length. For isothermal conditions in a compression or expansion volume, as has already been pointed out, the gas must be in thermal contact with the wall some 30 times during a stroke. Therefore the gas must travel 150 to 300 channel widths in turbulent flow to exchange heat. The fluid friction loss must be small, less than 1% for cycle efficiency. The friction loss will be the number of thermal exchange lengths, 30, times the kinetic pressure. The kinetic pressure is the pressure equivalent of the kinetic energy of gas flow. It is equal to half the density times the square of the velocity. This implies that the kinetic pressure must be about $3\times10^{-4}$ of $P_i$, or that the gas velocity must be less than about (2% × sound speed). This maximum flow velocity, 600 cm $sec^{-1}$ for air, or 1700 cm $sec^{-1}$ for helium, is a practical upper limit in either the compression element bellows or regenerator. At these velocities, and for typical bellows channel (convolutions) widths, 1 to 2 millimeters, the Reynold's number of a tapered channel and half width in contact with the walls turns out to be:

$$\text{Rey}=[(\text{width}/4)\times\text{velocity}]/[\text{kinematic viscosity}]$$

approximately 1,000 for air
approximately 100 for helium

The higher sound speed of helium is compensated by its much larger (times 7) kinematic viscosity (i.e., viscosity/density) than that of air. These values of Reynold's number are just where turbulent flow heat exchange increases above laminar heat exchange, and hence the heat flow will be partly laminar and partly turbulent. It will be turbulent only if the maximum velocities are induced. It will be laminar for most practical cases where helium is used as the working gas. Since the advantage of helium (or hydrogen) for Stirling cycle engines is so well recognized, a factor of 8 to 10 improvement in performance, most practical engines or heat pumps will use the light gas and then the heat exchange will be primarily laminar and turbulent heat exchange can be neglected. It is ironic that heat flow in positive displacement adiabatic-cycle engines is undesirable and primarily turbulent and in isothermal machinery where we want heat flow it is primarily laminar, but this is the result of channel size and gas properties.

Laminar Heat Flow in Stirling Cycle Bellows Machines

Laminar heat flow can be characterized by a diffusivity, D. For helium, $D=P_i^{-1}$ cm$^2$ sec$^{-1}$, where $P_i$ is measured in atmospheres of absolute pressure. In air it is 1/7 as much, or $D=1/7\ P_i$. Since $P_i$ for most practical machines using bellows and helium at 1 to 2 atmospheres, D will be 1 to ½ cm$^2$ sec$^{-1}$. The mean distance to a bellows convolution wall (2 walls per convolution) is ¼ the convolution spacing. The time constant for heat transfer is then $$\text{time}=(\text{width}/4)^2 P_i \text{ sec}$$

A typical average spacing during the stroke is 1 mm (2 mm extended spacing), so that the thermalization time becomes:

$$\text{time}=1800 \text{ sec}$$

If the thermalization must take place 30 times in a stroke, then the minimum stroke time becomes 1/30 second, a stroke frequency of 30 Hz to 15 Hz in revolutions. Such a bellows of 50 convolutions would have a stroke length of 10 cm. For a bellows of 20 cm diameter, the displacement volume would be 3,000 cm$^3$ and, for $P_i=2$ atmospheres, the circulating work would be 10 KW of which roughly ½, or 5 KW, could be used for heating, cooling, or power.

The Regenerator Design

The losses in a regenerator are: gas friction pressure drop, limited gas wall heat exchange, dead space volume, limited regenerator heat mass, and regenerator mass conduction loss. The first is the most important, as already pointed out. The requirement of heat exchange with the walls is roughly the same as the compressor-expander heat exchange except that heat exchange is not a direct mechanical energy loss so that only 5 to 10 heat exchange lengths are required. The dead space volume directly reduces the specific power because it limits both the phase angle as well as the compression ratio. The regenerator dead volume should be no more than 1/10 of the compressed volume or about 4% of the displacement volume. The limiting gas velocity has been calculated for helium as 1700 cm sec$^{-1}$ for 30 exchange lengths, and so twice this, $3\times10^3$ cm sec$^{-1}$, can be used for the regenerator, provided it is designed to be less than 7.5 thermal or friction exchange lengths long. Since the displacement volume is (pi r$^3$), and the displacement or stroke occurs in a limiting time of 1/30 sec, the effective regenerator cross-sectional area for this example becomes:

$$\text{Area}=[\text{displacement volume}]/[(\text{stroke time})(\text{maximum gas velocity})]=30 \text{ cm}^2$$

Since the gas volume of the regenerator cannot be more than 4% of the displacement volume, the effective length of the regenerator must be:

$$\begin{aligned}\text{length} &= (4\% \times \text{displacement volume})/\text{Area}\\ &= 4\% \text{ (stroke time)} \times \text{(gas velocity)} = 4 \text{ cm}\\ &= 0.4 \times \text{radius of bellows.}\end{aligned}$$

This very small length governs the geometry of the machine. Before discussing this we must consider the geometry of the gas channels and the heat exchange medium of the regenerator.

The total length is 4 cm and roughly 8 exchange lengths are desired. Then a heat exchange length equal to a viscous exchange length of 0.5 cm is desired.

$$\begin{aligned}\text{heat viscosity exchange length} &= (\text{width}/4)^2(\text{velocity}/D)\\ &= 0.5 \text{ cm}\end{aligned}$$

$$\text{velocity} = 3{,}000;\ D = P_i = 2;\ \text{then the channel width} = 0.07 \text{ cm}$$

The channels must be 0.07 cm wide—hence corregated metal is suitable. The thickness of the metal must be determined by the heat mass, the lengthwise conductivity and the thermal skin depth of the metal. The heat mass of the helium gas at 2 atmospheres is roughly $4\times10^{-4}$ cal cm$^{-3}$deg$^{-1}$ so that if the heat mass of the metal is to be $\times20$ that of the gas, a total of 30 cm$^3$ of metal is required. Since the gas volume of the regenerator is length $\times$ area$=120$ cm$^3$, this is ¼ the volume of the regenerator. Therefore foil ¼ of the channel spacing thick will supply the required heat mass. The foil thickness becomes 0.02 cm. The thermal skin depth in the metal in a stroke time of 1/30 sec is skin depth$=(D\times\text{time})^{½}=0.08$ cm for $D=10^{-2}$cm$^2$sec$^{-1}$ for stainless steel. Since the skin depth is very large compared to the half foil thickness, thermal lag in the foil can be neglected.

The longitudinal heat conduction through the foil from hot to cold end is $$\begin{aligned}\text{heat loss} &= \text{Delta } T\,[(\text{area} \times \text{conductivity})/\text{length}]\\ &= 0.063 \times (\text{Delta } T) \text{ watts.}\end{aligned}$$

This is a negligible heat loss for all reasonable temperature differences limited by material properties.

We therefore have designed a regenerator that meets all the design criteria. A regenerator of this design has been built and tested, and in all respects it agreed with this simple theory.

With this regenerator design and bellows compressor-expander units we can define the full thermal cycle machine.

Review of Design Criteria

The compressor-expander units must be the heat exchangers of the machine. Therefore the surface to volume ratio must be as large as possible. Metal bellows uniquely satisfy the criteria. No gas volume may remain isolated from a thermal reservoir for even a small fraction of a cycle. Therefore no large volume remote from the bellows walls may exist. The smallest irreversible loss, e.g. on the order of 3%, makes a significant difference to the performance of the machine. Therefore the bellows compressor-expander units must be either a nested pair of bellows with a relatively small annular gap, a bellows design where the inner diameter is very small compared to the outside radius, or a bellows with baffles at the convolutions of the baffles that intersect the interior volume. Since the area is proportional to the radius squared, the inner hole size of such a single bellows compressor expander unit should be of the order of 1/6 to 1/10 the outer radius.

In the regenerator gas friction pressure drop is a more important design criteria than the many other characteristics such as dead volume, heat exchange, heat mass, conduction loss, and skin depth. All dead volume should be minimized, even if the gas is isothermal, so that a compression ratio approaching e-fold (times 2.72) is maintained at the largest possible phase angle approaching 120°. Mechanical friction losses should be maintained small.

Resulting Design

The two bellows compressor-expander units (one hot and one cold) must be connected by the regenerator. If they were separated, there would be no possibility of transferring the working gas without prohibitive pressure loss or dead volume. This leads to the configuration of a regenerator with compression-expander units (either a nested bellows pair or a small inside diameter bellows) at each end. The regenerator design is described above. It is the mid-plane member that supports one end of each bellows. The bellows are then compressed or expanded against the regenerator by a suitable mechanism. Heating or cooling air, gases or even a liquid will then be caused to flow across each bellows to establish a hot and cold ends. Since the heating or cooling fluid flow external to the bellows need only make one heat exchange length with the bellows wall, the velocity can be higher and is nearly continuous. Therefore heat exchange can be turbulent and significantly greater than inside the bellows. The air or gas can blow across the surface transverse or parallel to the bellows axis and with or without swirl will give adequate heating or cooling. If a liquid is used external to the bellows, it is incompressable, and so two compression-expansion units 180° out of phase should be used in the heat exchange volume.

A Stirling cycle heat pump having bellows compressor and expander units at opposite ends of a stationary regenerator has been proposed heretofore (see Raetz U.S. Pat. No. 4,010,621, issued March, 1977). The Raetz design uses heat exchangers separate from the bellows walls, and the bellows leave large trapped adiabatic volumes. The present invention involves two critical differences from the Raetz patent design that provide an efficiently working machine—the use of the bellows as the heat exchange elements and a configuration for the bellows working chambers that ensures numerous heat exchanges between the gas and the bellows in each cycle due to the absence of large trapped adiabatic gas masses.

There are other prior patents and literature disclosing bellows machines that look like the present invention, but they do not describe or suggest all of the requirements of this invention, which provide remarkable increases in efficiency. Among such patents and literature are the following: Frankl U.S. Pat. No. 1,808,921, June 9, 1931; Kohler et al. U.S. Pat. No. 2,611,236, Sept. 23, 1952; Schuman U.S. Pat. No. 3,827,675, Aug. 6, 1974; the Walker book, supra.

Driving Mechanism

The driving mechanism will be either a rotating mechanical drive with cranks, crank arms, and cross heads or it can be a free piston engine(s), either an electrical linear motor or fuel driven engine. In general, an Otto or diesel free piston engine will be more efficient than a bellows heat pump engine because of the limitations in hot side termperature imposed by the highly and alternately stressed bellows. However, a bellows heat engine and heat pump combination can be made where a small, high temperature difference engine unit drives a larger low temperature difference unit as a heat pump with significant thermal gain. The Otto or diesel free piston engines have the disadvantage of lubrication and wearing parts. A bellows Stirling cycle engine will have longer life and provide more complete combustion.

Bellows Design

Welded metal bellows are now a commercially available item from several manufacturers. In general they are specialty items that are expensive and difficult to manufacture without flaws. In particular, the fatigue life is limited by the metallurgy at the stress concentration points adjacent to the welds where the metallurgy is critical and partially degraded from the original material.

A bellows in a Stirling cycle heat pump can always contain a positive pressure, i.e. $P_i$ greater than 1 atmosphere. In this case the inner diameter seam of the convolution will be in compression and will not flex as much and therefore not fatigue. This is important for the bellows design where the inner diameter is much smaller than the outer diameter because, if the bellows were extended, the tensile stress would be larger and rapidly fatigue the bellows.

I recommend instead a bellows construction specifically for use in small temperature difference, room temperature bellows heat pumps. Such a construction is cheaper and conducive to a longer life because of the lack of welds. The seams are glued with a modern elastomer, such as silicon rubber, that has nearly infinite flexure life. The inner seam of each convolution is glued with no support since it is always in compression. The outer seam is glued but backed up with a rolled crimped "U" shaped channel. The channel and elastomers distribute the stresses better than a welded joint.

I also prefer to provide a baffle plate in each convolution of the single bellows so that the gas cannot go as easily directly through the chambers central hole of the bellows but instead must follow a zig-zag path between convolutions. The hole size must become progressively larger towards the regenerator end of the bellows to keep the gas friction low enough. These baffles also increase the strength of the bellows against the squirming mode failure so that a larger length to diameter can be used.

Bellows Springs

When a free piston drive is used for the displacement of the Stirling cycle compressor-expander unit, the problem frequently is the requirement of an energy storage mechanism or spring. If a standard steel spring is used, then the metal weight of the spring for a given energy storage turns out to be large, relative to the other components and the frequency is reduced. This is particularly true where a linear electric motor is used tied to a 60 cycle power line. The electrical frequency can be reconstituted but such components are expensive and the efficiency is reduced. Consequently, there is a requirement for a high efficiency gas spring.

Normal gas springs of a cylinder and a piston suffer the usual partial adiabatic loss discussed so often in the disclosure. In addition, sliding friction and leakage add to the losses. An isothermal bellows gas spring on the other hand can be very much more efficient, as already discussed. The ideal gas spring is an opposed Stirling cycle isothermal compressor-expander unit. Two opposed units therefore supply the gas springs to the opposite member of the pair. Consequently we disclose embodiments of free piston machines as opposed units within a housing. In this case, a mass is provided to cause a phase delay from one spring to another. One spring is the compressor and one the expander. A central mass is driven between two units either as an electrical armature or if one pair is a heat engine and the opposite a heat pump, then the central mass between the two units stores and transmits the energy from the engine to the heat pump. A separate isothermal bellows spring is disclosed that can be used in either application where the weight of a metal spring is a disadvantage. The efficiency of such a spring is important which means that the heat transfer from the gas to the walls must be as high as possible. Since no transfer of gas is required, the floating baffle bellows are optimum and only small holes are needed to supply the allowed initial equilibrium with a fill gas. Here, helium or hydrogen is the preferred fill gas. The Q (inverse damping coefficient) will not be as great as for metal springs and the Q will be frequency dependent, but the mass will be less, about one-tenth of that for equivalent energy storage of the metal spring. This ratio of mass to energy is derived from the fact that the maximum energy density of steel stressed to a conservative value of 30,000 psi is about 2 atmospheres and the same as that used in the bellows. The bellows on the other hand have a metal thickness that is about one-tenth the spacing of the convolutions. Therefore, the mass ratio is about one-tenth.

House Size Heat Pump

The thickness of the bellows wall depends upon the working pressure and dimensions but with typical available materials having good fatigue life and strength like steel, phosphorous bronze, or beryllium copper, working at 2.5 atmospheres pressure, 600 cycles per minute and 30 to 40 cm in both diameter and length, the wall thickness becomes about $\frac{1}{4}$ the thermal skin depth. Then, the heat mass of the wall is the entire wall thickness. For example, let the pressure ratio of the cycle be 2.5:1; then the maximum pressure difference, $P_{diff}$, becomes:

$$P_{diff} = 2.5 - 1 = 1.5 \text{ atmospheres.}$$

The span, s, is the difference in the inner and outer radius of a bellows. In our example we choose a 7 inch outer radius and a 6 inch inner radius. The span becomes s = 1 inch. We choose a conservative metal thickness of t = 0.004 inches. Then the wall stress due to the pressure alone becomes:

$$\text{wall stress (pressure)} = P_{diff}s/t = 2600 \text{ PSI.}$$

This is a very small stress increment and bending stresses of the bellows will be significantly larger.

For a fractional cycle time of 1/100 sec for compression, the thermal skin depth, d in steel ($D = 0.2$ $cm^2sec^{-1}$) becomes:

$$d = 0.04 \text{ cm} = 0.016 \text{ inches or four times the thickness.}$$

Then the heat mass of the wall becomes the entire wall thickness. The fractional thermal lag of the wall will be less than the ratio of the heat mass of the gas to heat mass of the metal or 1% for 10 convolutions of the bellows per inch. If the outside wall is maintained at an adequately constant temperature by cooling or heating air flow, this small thermal lag favors an isothermal cycle.

Coefficient of Performance

All heat pumps have an efficiency called the coefficient of performance (COP) which is the ratio of the heat out to the mechanical work in. Typical heat pumps for the home have a COP of 2 to 2.5. The ideal efficiency is $(T_2)/(T_1 - T_2)$ where $T_1$ and $T_2$ are the respective temperatures of the hot and cold reservoirs. Both cycle inefficiency as well as refrigerant properties lead to the small COP compared to a typical ideal heat pump where $(T_1 - T_2)$ or $T_{diff} = 30°$ K., $T_2 = 300°$ K. and the ideal COP = 10 for house heating and cooling. The difference between ideal and practical is the inefficiency of compressor and expander and the necessity of $T_{diff}$ being larger for typical refrigerants. For example: let $T_{diff} = 30°$ K. leading to an ideal COP of 10. If the efficiency of the compressor and expander is 80% each, then the net COP is 2.9. (One unit of mechanical work is put in producing 0.8 units of heat. The mechanical energy recovered by the expander is 0.8 units of heat. The mechanical energy recovered by the expander is 0.8 of the Carnot efficiency of 0.9 for T = 30° C. Therefore the net mechanical work is $[1 - (0.9 \times 0.8)] = 0.28$. The COP is useful heat/mechanical energy = 0.8/0.28 = 2.9.) The Carnot cycle can be used as well as an isothermal one, but the isothermal one has the advantage of higher working pressure for the same COP, and in addition the COP improves for smaller $T_{diff}$, independent of constant stroke. The bellows machinery also has the possibility of having smaller losses, no additional heat exchangers and ease of construction.

A typical design would be a volume ratio, $C_R = 2.41$, ideal COP = 10, and a heat transfer of $(G - 1) \ln C_R = 35\%$ of the heat of the gas (G is the ratio of specific heats of the gas = 1.4 for air) or $\ln C_R = 0.88$ of the pressure energy of the gas. For our example of a volume displacement of 27,000 $cm^3$, at 600 rpm, the heat out would be 24 kw with an input of 2.4 kw + 24 $(1 - \mathbf{eff}^2)$ where eff is the efficiency of the compressor and expander. If the efficiency is 95%, then the input energy is $2 \times 2.4$ kw or the COP = 5. We therefore see that the isothermal cycle offers a significant advantage for heat pump machinery, provided the efficiency of the compression and expansion machinery is high. It should be recognized that the isothermal compression can not easily be used for normal refrigerant compression because the refrigerant will condense to a liquid in the compression cycle just as it normally would do in the condenser after compression. The transfer of the liquid refrigerant out of the compression volume before any expansion takes place would be exceedingly difficult. Therefore the isothermal cycles are practically limited to the use of a gas during the entire cycle.

One can use a totally sealed system with a gas of a higher value of G like helium or argon (G=1.67) and at a higher pressure and achieve greater heat output for a given cycle.

The crank-driven bellows isothermal machinery is driven slowly (say 10 Hz) and so becomes bulky. It is well suited to house heating and cooling. It is also suited to air compressors because of the lower mechanical work required in the isothermal cycle needed to produce a given volume of "cold" compressed air.

DESCRIPTION OF THE EXEMPLARY EMBODIMENTS

Stirling Cycle Bellows Heat Pumps Generally

Figure 1:
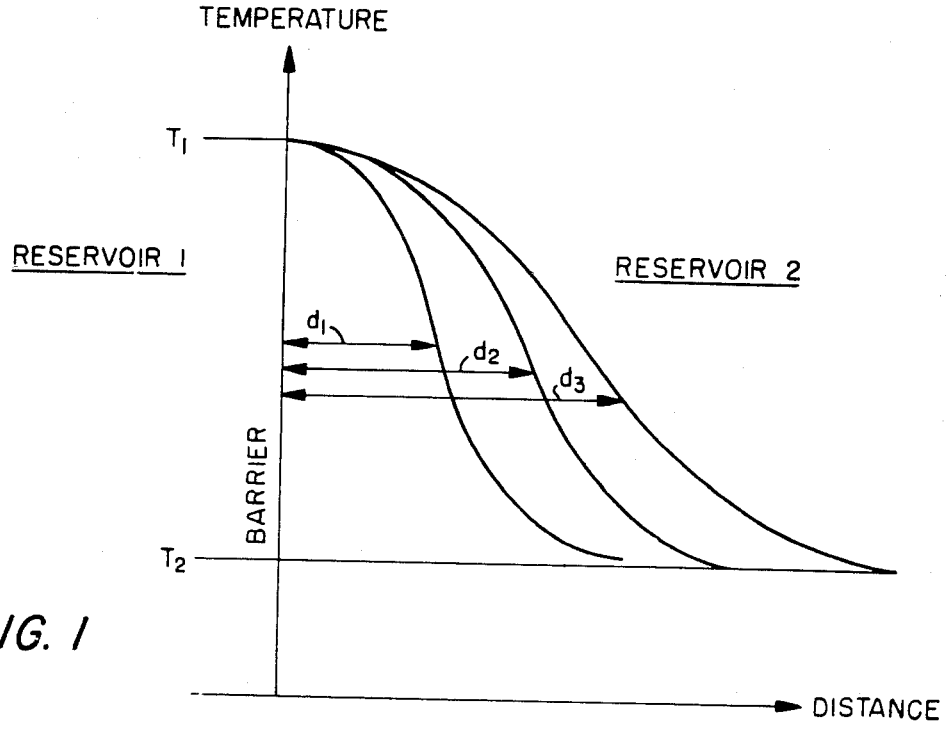
FIG. 1 is a diagram of transient heat transfer into a uniform material.
Figure 2:
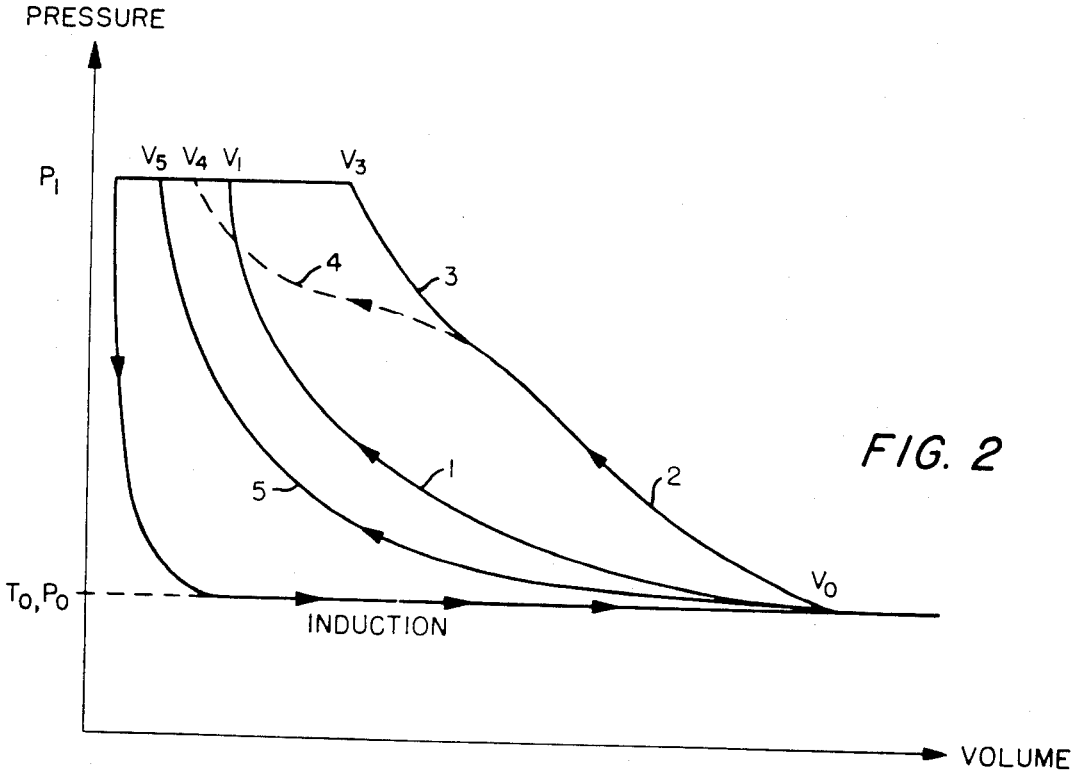
FIG. 2 is a PV diagram of various heat cycles.
Figure 3:
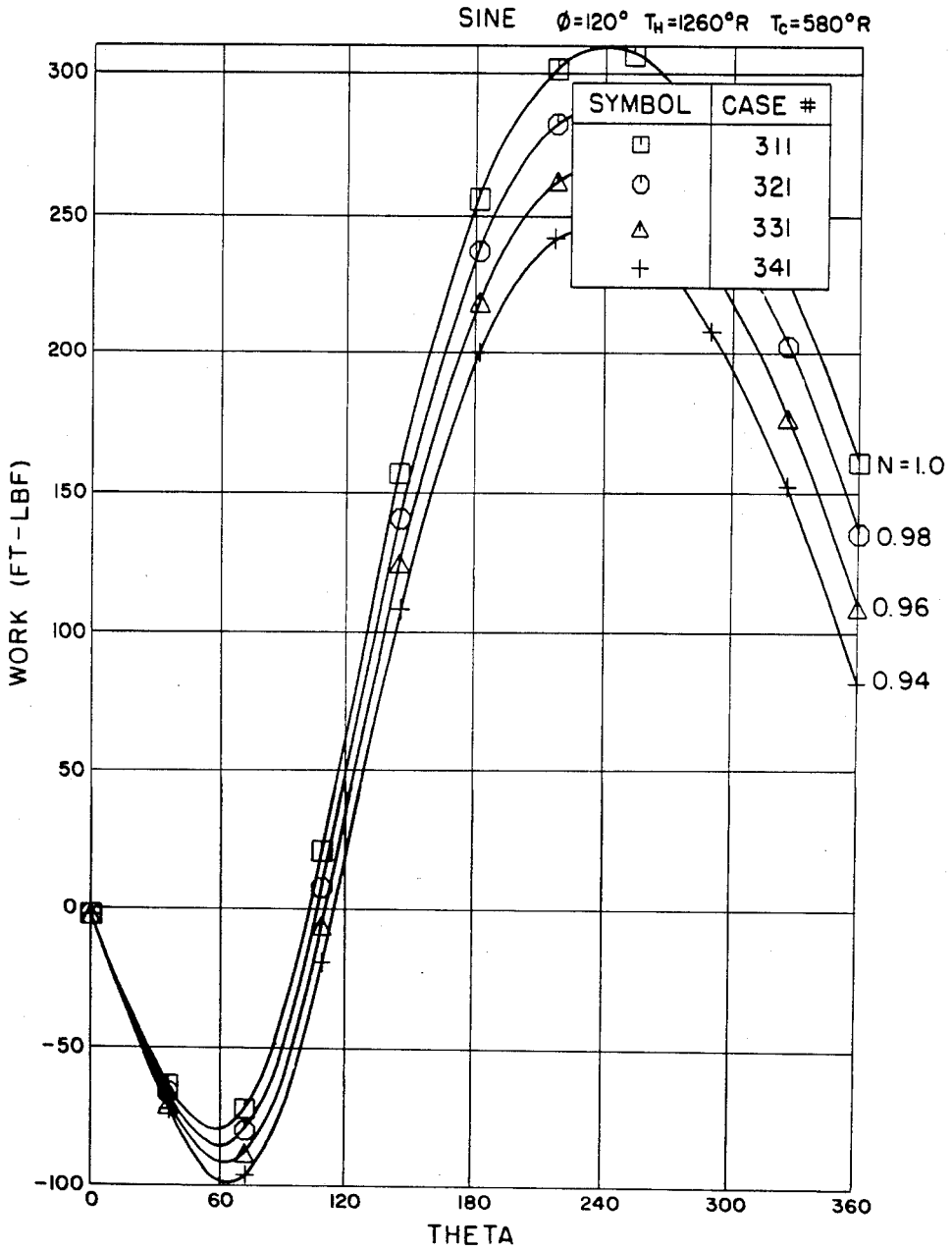
FIGS. 3 to 6 are graphs of work during a cycle for Stirling cycle machines with different phase angles and showing the affect of losses on performance.
Figure 4:
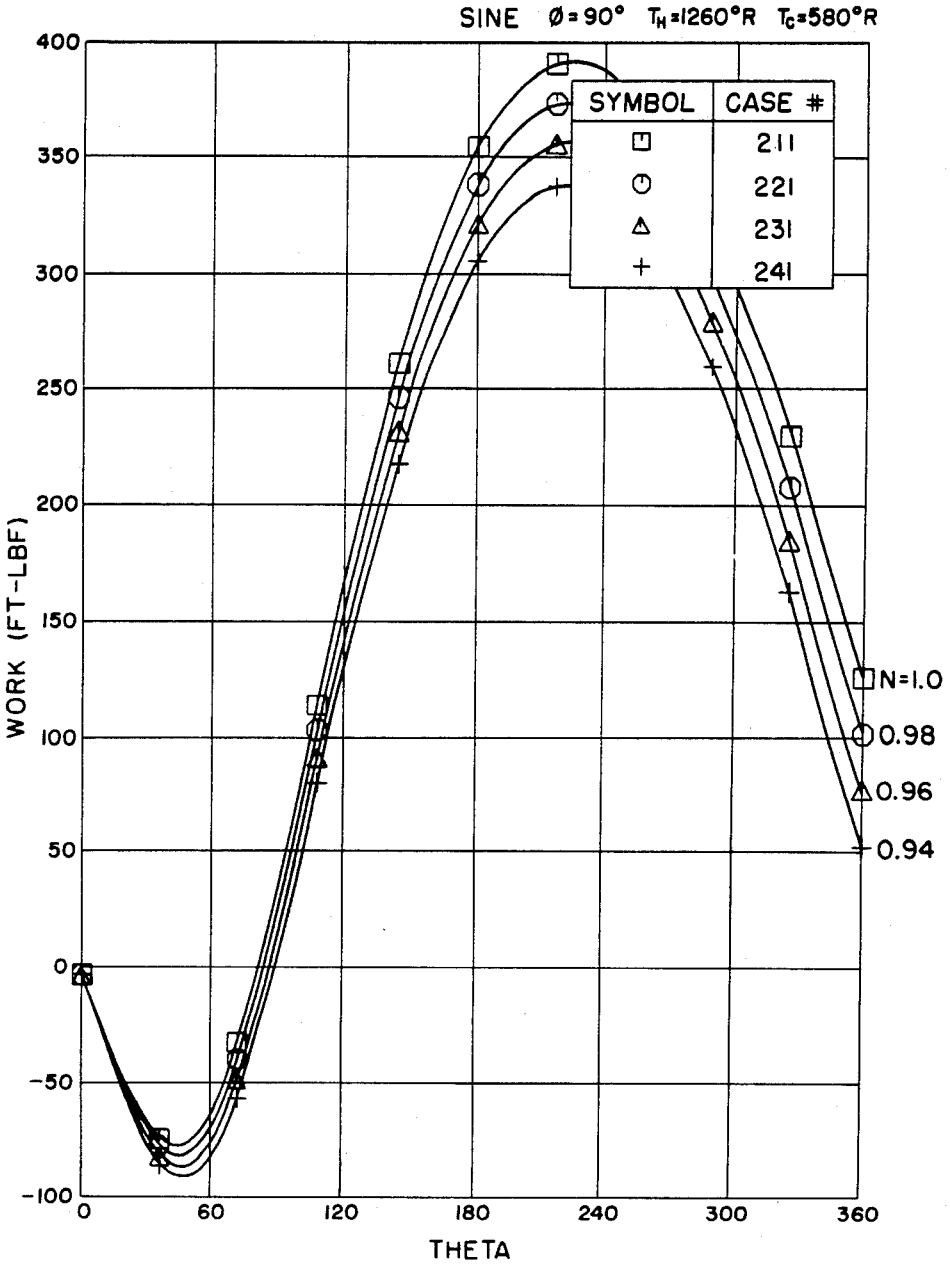
Figure 5:
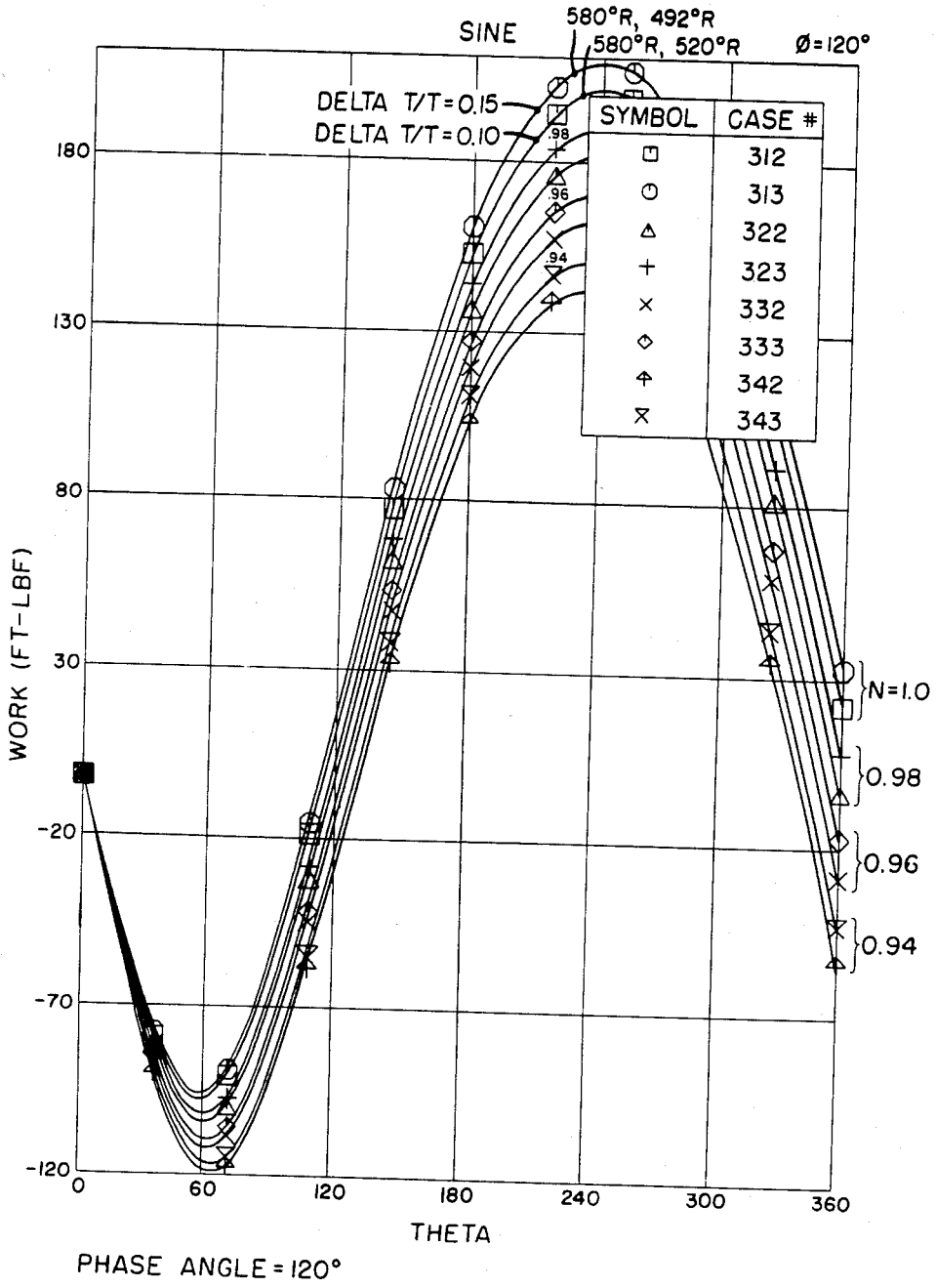
Figure 6:
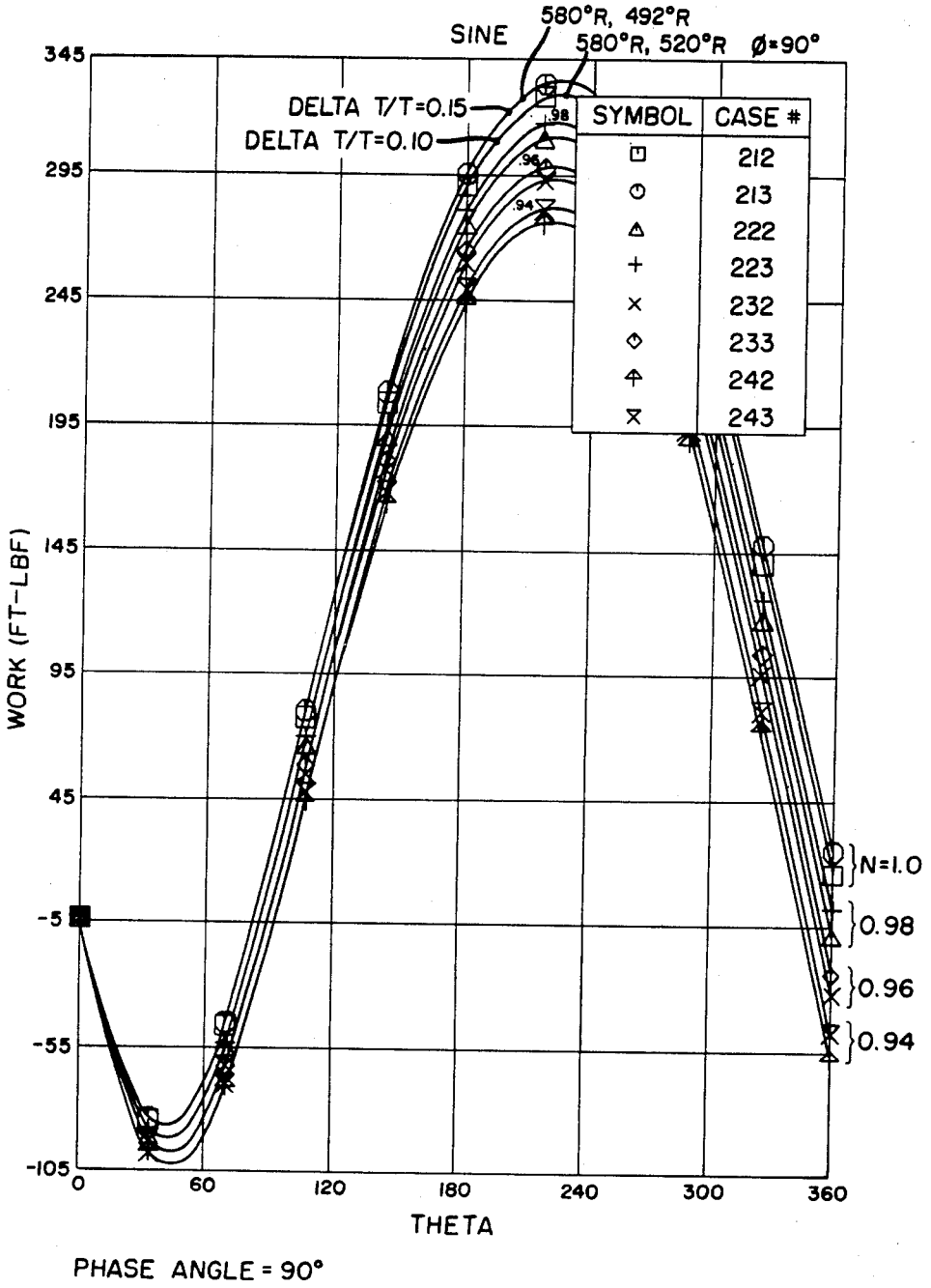
Figure 7:
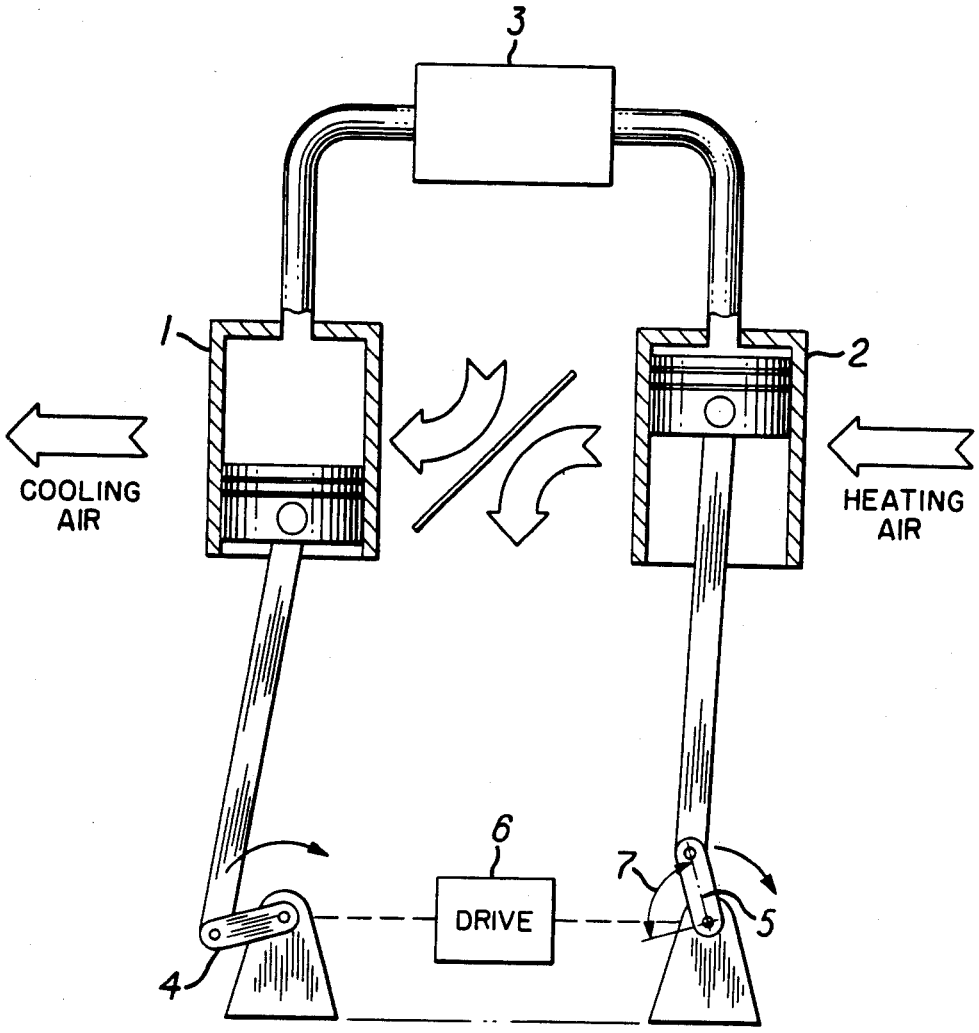
FIG. 7 is a side cross-sectional schematic drawing of a typical Stirling cycle heat pump.

Referring to FIG. 7 a standard Stirling cycle heat pump is shown schematically. The compressor variable volume 1 and expander variable volume 2 are connected for gas transfer through a heat exchange regenerator 3. The compressor and expander are driven by a drive 6 through crank arms 4 and 5 at the relative angle 7 of 90°. Cooling air (gas) is blown across the compressor chamber 1 and similarly heating air is blown across the expansion chamber 2.

In operation the compression of the gas in volume 1 heats the gas, but the high heat transfer through the walls of volume 1 and to the cooling air keeps the gas inside volume 1 isothermal at temperature $T_1$. At the top of the stroke, the gas leaves the chamber 2 and passes through the regenerator 3. The regenerator 3 is of the standard type and merely represents a large heat mass, usually sponge metal, that transfers the heat of the gas at $T_1$ to a reservoir by cooling the gas to temperature $T_2$. This heat is returned later during the reverse stroke. When volume 1 is near constant at top dead center, the gas in volume 2 enters at temperature $T_2$ and is expanded. As it cools further by expansion it is reheated by the heat transfer from the heating air through the walls of volume 2 maintaining the gas isothermal during expansion. The return stroke of 2 returns the gas to 1 through the regenerator to volume 1. The regenerator now returns the heat $T_1-T_2$ to the gas entering 1 and a new compression cycle starts with gas at $T_2$ and remains isothermal. The energy transferred is proportional to $T_2 \ln R_c$ ($R_c$=compression ratio), and the energy gained back in expansion is $T_1 \ln R_c$, so that the net work becomes $(T_2-T_1) \ln R_c$. The coefficient of performance (COP) as a heat pump is then:

$$\text{(heat delivered)/(energy used)} = T_1/(T_1-T_2) \text{ or the ideal thermal efficiency.}$$

The losses are the friction of the parts and the inefficiency of heat transfer. The heat transfer is why we use bellows for compression and expansion volume.

Bellows Heat Pump

Figure 8:
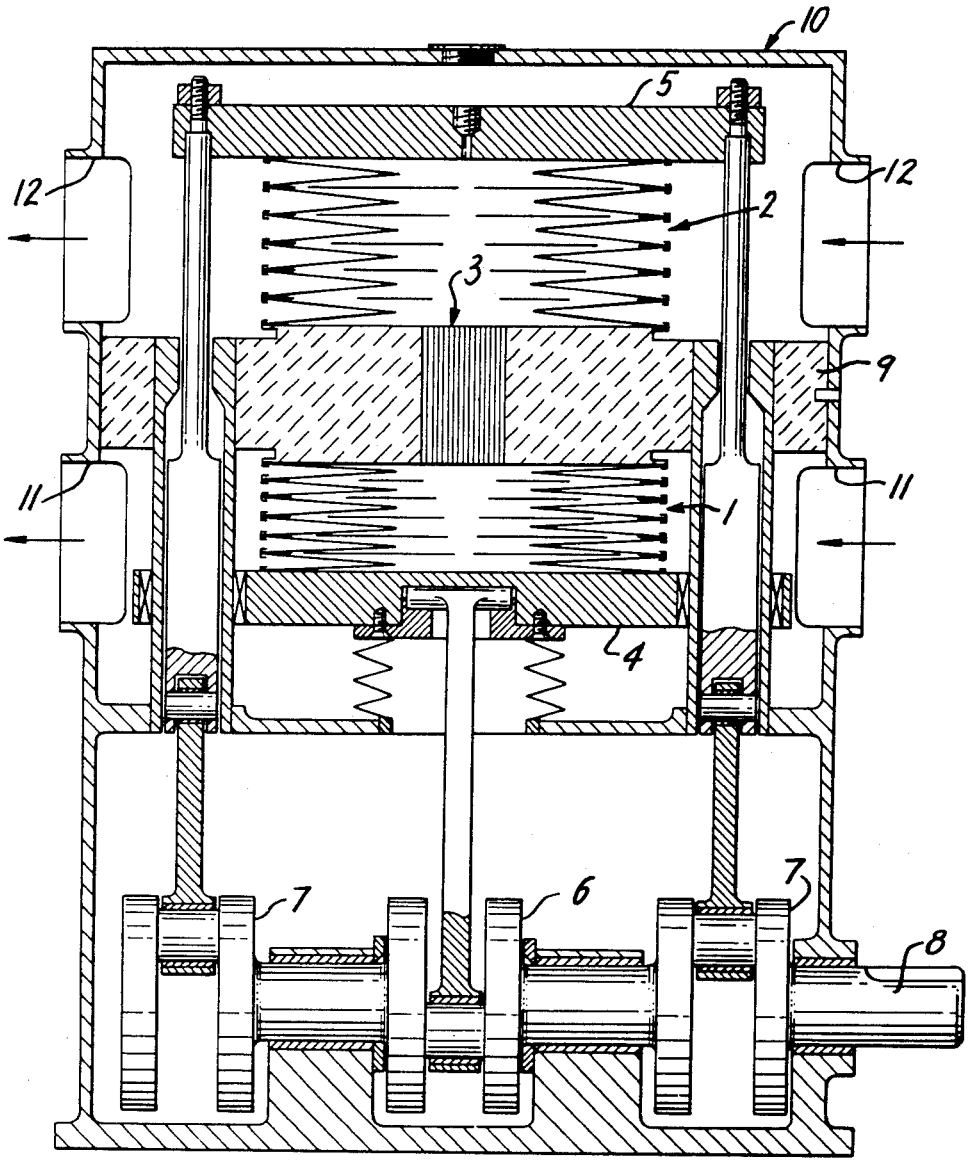
FIG. 8 is a side cross-sectional view in generally schematic form of a bellows Stirling cycle heat pump embodying the present invention.

In the heat pump shown in FIG. 8, the compression chamber 1 and expansion chamber 2 are of the single bellows type having rippled baffles extending from the outside diameter seams into the central volume. The design parameters for such chambers are described in more detail above. The chambers are connected for gas transfer by a heat exchange regenerator 3. The required characteristics for the design of the regenerator have also been thoroughly described above. The regenerator 3 is maintained in an insulating plate 9, which may be made of a plastic in the case of heat pumps, but for machines of similar design but for high temperature use should be made of a ceramic. The regenerator 3 is made from a strip of corrugated or crinkled metal foil and a strip of flat foil rolled up together in much the same manner as is shown in Frankl U.S. Pat. No. 1,808,921. The plate 9 is affixed within a housing 10 that surrounds the entire unit. Ports 11 in the housing provide for the supply and discharge of a flow of cooling gas (usually air) to and from the section of the housing containing the compressor and ports 12 admit and discharge a flow of a heating gas (usually air) that has been blown through the expansion chamber 2.

The ends of the bellows remote from the mounting plate 9 are affixed to movable end walls 4 and 5 that are driven through connecting rods by crank arms 6 and 7 on a motor driven shaft 8. The crank arms are at a relative angle of 60°. Inasmuch as the compressor and expander chambers are at opposite ends of the machine, 180° apart, the desired phase angle of 120° is provided by setting the crank arms 60° apart in order to obtain the phase angle, i.e., 180°−60°=120°.

Figure 9:
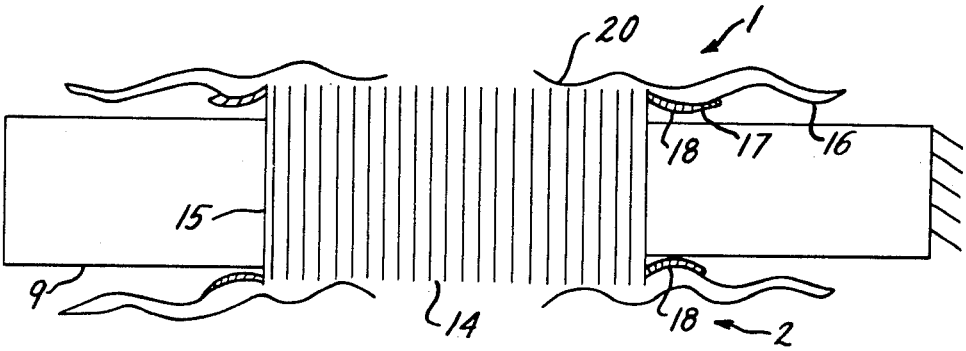
FIG. 9 is a side cross-sectional detail view of the regenerator and part of a bellows.
Figure 10:
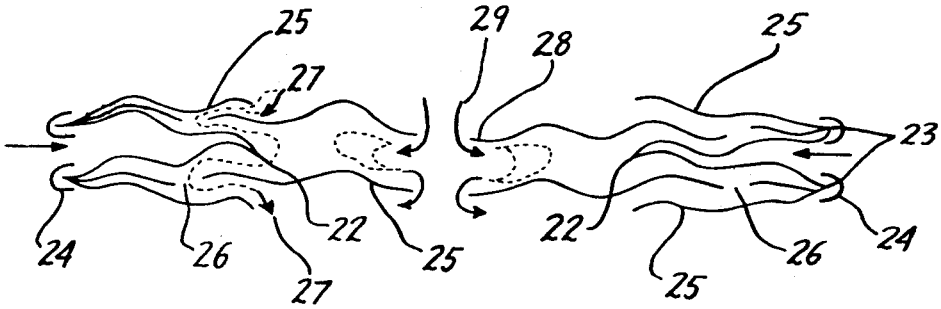
FIG. 10 is a detailed side cross-sectional view of a portion of a rippled bellows with baffles.

It is preferred, though not required, to make the bellows with rippled walls, e.g. 20 as shown in FIGS. 9 and 10. The rippled bellows in each expansion chamber 1,2 are attached to the plate 9 by a tubulation 15, it being suitable for the end convolution 16 to be joined to the tubulation expansion portion 18 by an elastomeric adhesive 17, such as a silicon adhesive. FIG. 9 also shows the regenerator as it appears in cross section. Every other line represents the strip of flat foil and the remaining lines represent the strip of corrugated foil. This construction provides a myriad of small heat transfer passages for heat exchange between the gas and the regenerator mass.

As can be observed in the more detailed illustration in FIG. 10 of the rippled bellows and baffles, the convolutions are joined by welds or by an elastomeric adhesive at inside joints 22 and outside joints 23. The strength of the outside joints 23 may be augmented by a U-shaped crimped seal element 24. In general, the adhesive joints are limited to relatively low temperature uses. High temperature bellows for heat engines will probably have to use welded construction. The baffles 25 have holes 26 near their perimeters that compel the gas to follow a tortuous path 27 in and out of the convolutions. Central holes 28, which may be off center and staggered plate to plate cause turbulent circulation 29 between the baffles, thus ensuring close thermal contact of the internal gas with the inside surfaces.

The machine shown in FIGS. 8 to 10 operates as follows. The compression of the gas in volume 1 heats the gas, but the high heat transfer to the walls of chamber 1 and to the cooling air keeps the gas inside [chamber] 1 isothermal at temperature T1. During the compression stroke of chamber 1, the gas enters the chamber 2 from the regenerator 3. The regenerator represents a large heat mass of small volume, small impedance to gas flow, and small longitudinal thermal conductivity that transfers the heat of the gas at T1 to a reservoir by cooling the gas to temperature T2. This heat is returned later during the reverse cycle. The gas in volume 2 enters at temperature T2 and is expanded. As it cools further by expansion, it is reheated by the heat transfer from the heating air 10 through the walls of volume 2 maintaining the gas isothermal during expansion. The return stroke of volume 2 returns the gas to volume 1 through the regenerator. The regenerator now returns the heat T1 minus T2 to the gas entering 1, and a new compression cycle starts with gas at T2 and remains isothermal. The energy transfer is proportional to $T_2 \ln C_R$, $C_R$=compression ratio, and the energy gained back in expansion is $T_1 \ln C_R$, so that the net work becomes $(T_2-T_1) \ln C_R$.

The coefficient of performance (COP) as a heat pump is then: (heat delivered)/(energy used)$=T_1/(T_1-T_2)$ or the ideal thermal efficiency.

The losses are the friction of the parts, gas transfer friction, and the inefficiency of heat transfer. The heat transfer is why we use bellows for compression and expansion volumes.

Referring again to FIG. 8, the compression volumes are the inside variable volume chambers defined by the rippled bellows with baffles. If nested bellows are used, the annular space between the bellows is the variable compression volume. Each set of bellows is driven by typical crank arms at a phase angle difference of 60°. The crank arms are driven, in turn, by a motor (or driver generator).

Finally, the compression ratio and maximum pressure is determined by the 60° crank angle or 120° phase angle between the compressor and the expander. The minimum volume corresponds to when the bellows are plus and minus 60° from top dead center. The volume then is $Vol_{min}=2\ (1-\cos 60)=1.0$. The maximum volume is then $Vol_{max}=2\ (1+\cos 60)=3.0$. The compression ratio, $C_R=3.0$. When the regenerator volume and dead volume of the bellows is added, about 0.3, the final compression ratio becomes 2.5. The maximum pressure is then 5 atmospheres, for $P_i=2$ atmospheres, or a pressure differential across the bellows of 4.0 atmospheres, or 58 psi. This leads to a reasonable stress in the bellows and hence long fatigue life.

Free Piston Heat Pump

Figure 11:
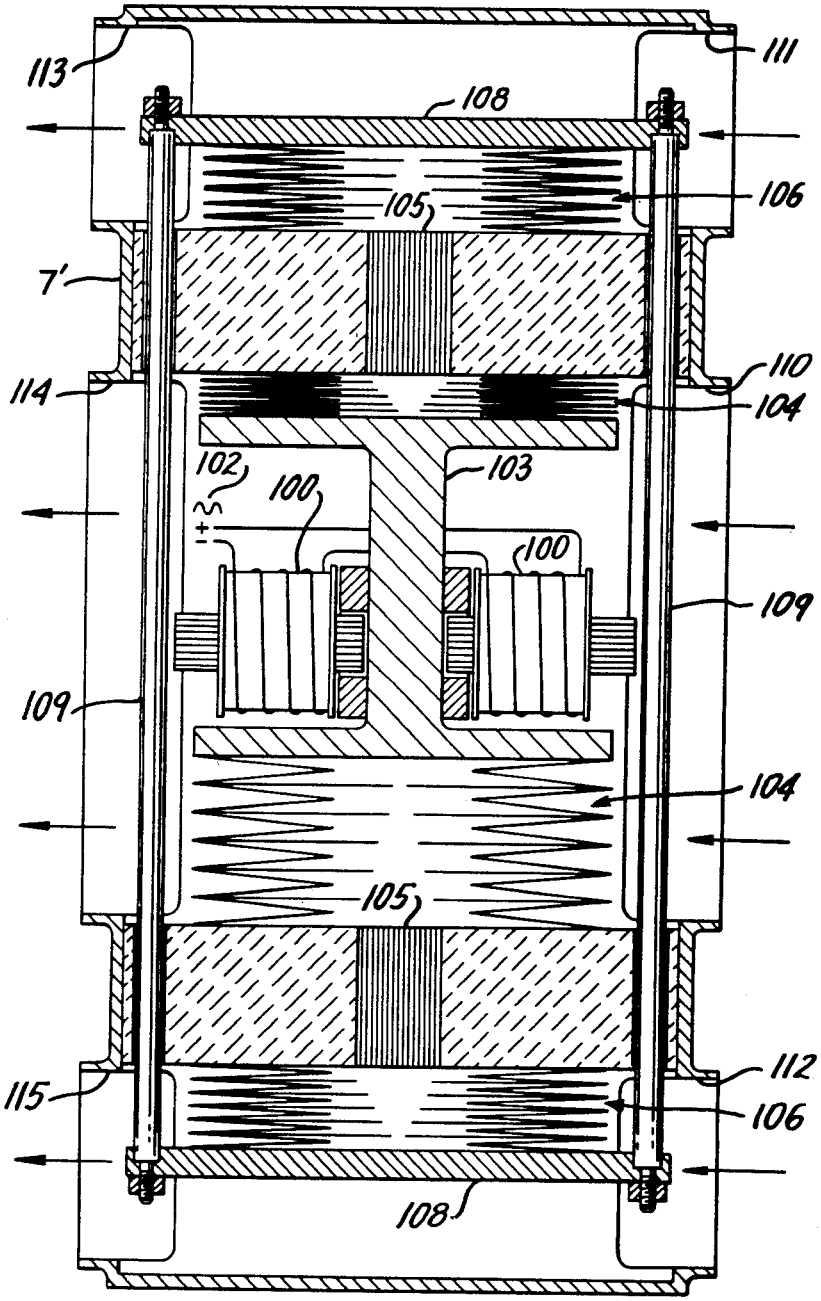
FIG. 11 is a side cross-sectional view in generally schematic form of a free piston heat pump embodying the present invention.

Referring to FIG. 11, electric coils 100 are energized by an alternating current 102 to alternately oscillate a hollow laminated iron armature 103 that resonates with two bellows compression chambers 104. Regenerators 105 are fixed to the housing 7'. Bellows expansion chambers 106 and heads 108 (end walls of chambers 106) are tied end to end by rods 109 so that the heads oscillate as a unit. The volume external to the chambers 104 and 106 and surrounded by the housing 7' allow the circulation of cooling and heating gases-air to inlet ducts 110 in the center and 111 and 112 at the ends. The air exits through ducts 113, 114, and 115.

In operation, regenerator heat pump units 104, 105, and 106 act as gas springs to the resonant mass of the armature 103. The oscillation of the mass of the armature 103 alternately compresses and expands each heat pump unit. The phase lag in the harmonic oscillation of each expander volume 106 relative to its compressor volume 104 is determined by the mass of the heads 108 and rods 109. Since the effective spring constant of the bellows can be adjusted by the initial pressure $P_i$, the heat pump springs and oscillating masses can be timed to give the appropriate resonant frequency of the AC line 102. For the 60 cycle current, these units will be fairly small, about a 2 cm stroke and 5 to 10 cm diameters, and $P_i$ will be 2 to 4 atmospheres. The bellows will be of the baffle design to maximize the heat transfer at the high frequency. To obtain the 120° phase lag, the mass of the heads and rods will be such that its natural frequency with the expander bellows 106 will be slightly less than the 60 cycle current. The armature mass 103 will be such that its natural frequency also will be slightly less than the 60 cycle current. Phase stability occurs due to the required energy input from the AC line. The ambient input air entering duct 110 comes out hotter at duct 114. The output air exiting ducts 113 and 115 comes out cooler than the input air at ducts 111 and 112.

Heat Driven Heat Pump

Figure 12:
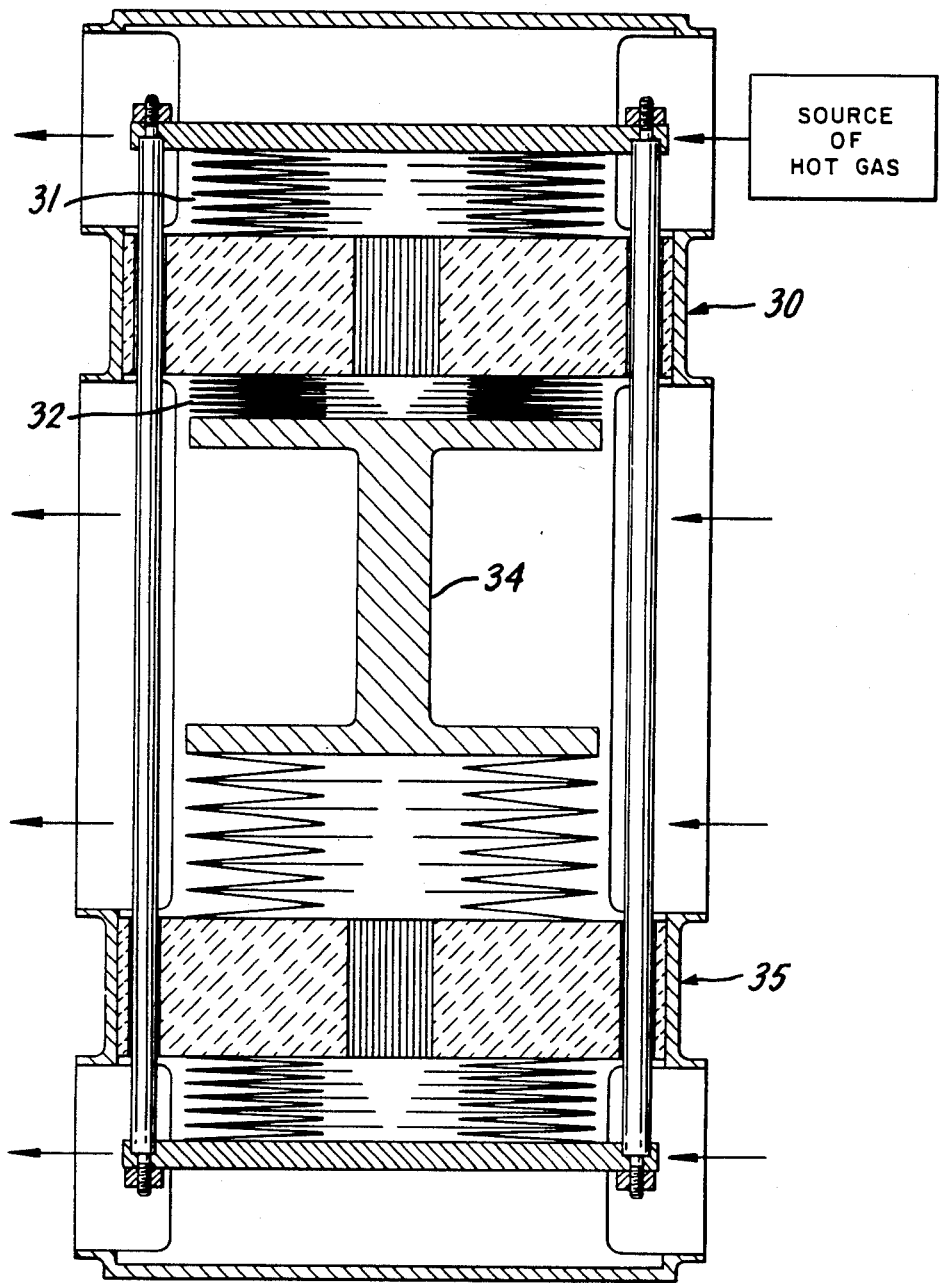
FIG. 12 is a side cross-sectional view in generally schematic form of a heat driven heat pump embodying the present invention.

Referring to FIG. 12, a free piston heat pump can be driven by a free piston heat engine 30 to augment the net heat output or give refrigeration. The configuration is the same as FIG. 11 (the electrically driven heat pump where two heat pumps are driven by one armature), but instead no electric coils are used and one end becomes the heat engine. The expander bellows 31 of the heat engine are smaller than the compressor bellows 32 because of the high temperature. The high temperature is derived from a source of hot gas 33, such as combustion of a fuel like natural gas. The high temperature bellows 31 are also of welded construction to withstand high temperature gases. The mass 34 serves to couple the energy from the heat engine to the heat pump 35. The mass 34 is such that its natural frequency is slightly less than the natural frequency of the engine so it drives the heat pump. In this fashion phase stable power will flow from the engine to the heat pump.

Bellows Stirling Cycle Heat Engine

Figure 13:
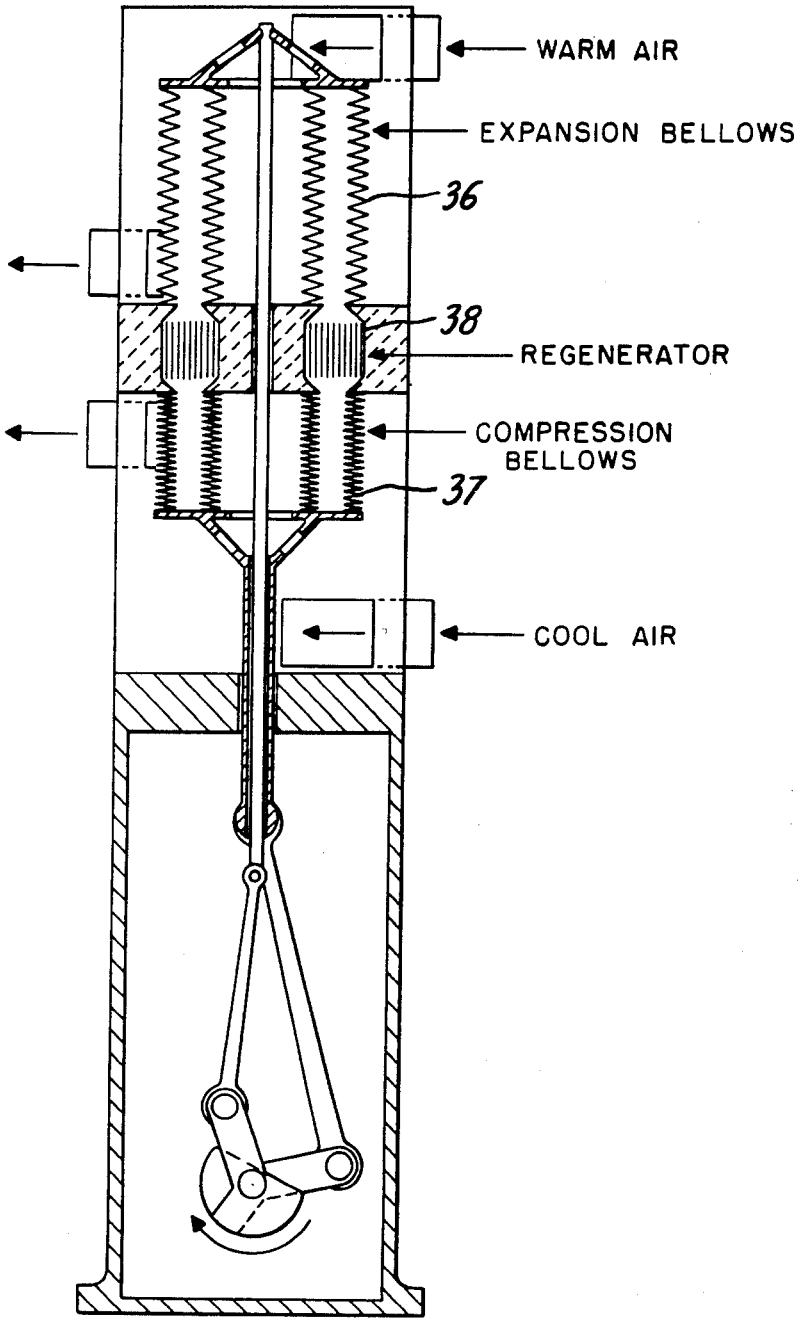
FIG. 13 is a side cross-sectional view in generally schematic form of a heat driven engine embodying the present invention.

The engine shown in FIG. 13 is very similar to the heat pump of FIG. 11, except that warm air supplies energy to drive the Stirling cycle unit and deliver output power through the connecting rods and cranks to the shaft. The illustrated embodiment has nested bellows chambers 36 and 37 and an annular regenerator 38, each designed as described above.

Isothermal Air Compressor

An air compressor is usually used where the adiabatic heat of compression is rejected before the compressed air is utilized. Under these circumstances the adiabatic heat is wasted. As I have already discussed, the average piston-cylinder combination is part way between adiabatic and isothermal. Furthermore the thermal skin depth effect somewhat enhances the work per cycle above that expected from partial heat exchange alone. Hence there is an efficiency advantage for air compressors of a purely isothermal compression cycle. The nested bellows performs the function for both compression and expansion. Moreover, the friction of the bellows driving machinery can be made small compared to a piston with rings inside a cylinder. For these reasons a cooled, nested bellows compressor will be significantly more efficient in producing a given volume of cold compressed air than a partially adiabatic one. The ratio of work energy between an ideal isothermal compression and an adiabtic one is:

$$\text{ratio of work} = [(G-1)\ln R_c]/[G(R_c^{(G-1)/G}-1)]$$

where $R_c$ is the compression ration and G is the ratio of the specific heats of the air, $G=1.4$. For a typical compressor supplying 120 PSI, $R_c=8.57$, and the ratio of work $=71\%$. Hence depending upon friction and partial heat exchange in the cylinders, something like 30% reduction in waste heat can be obtained by using an isothermal compressor.

Figure 14:
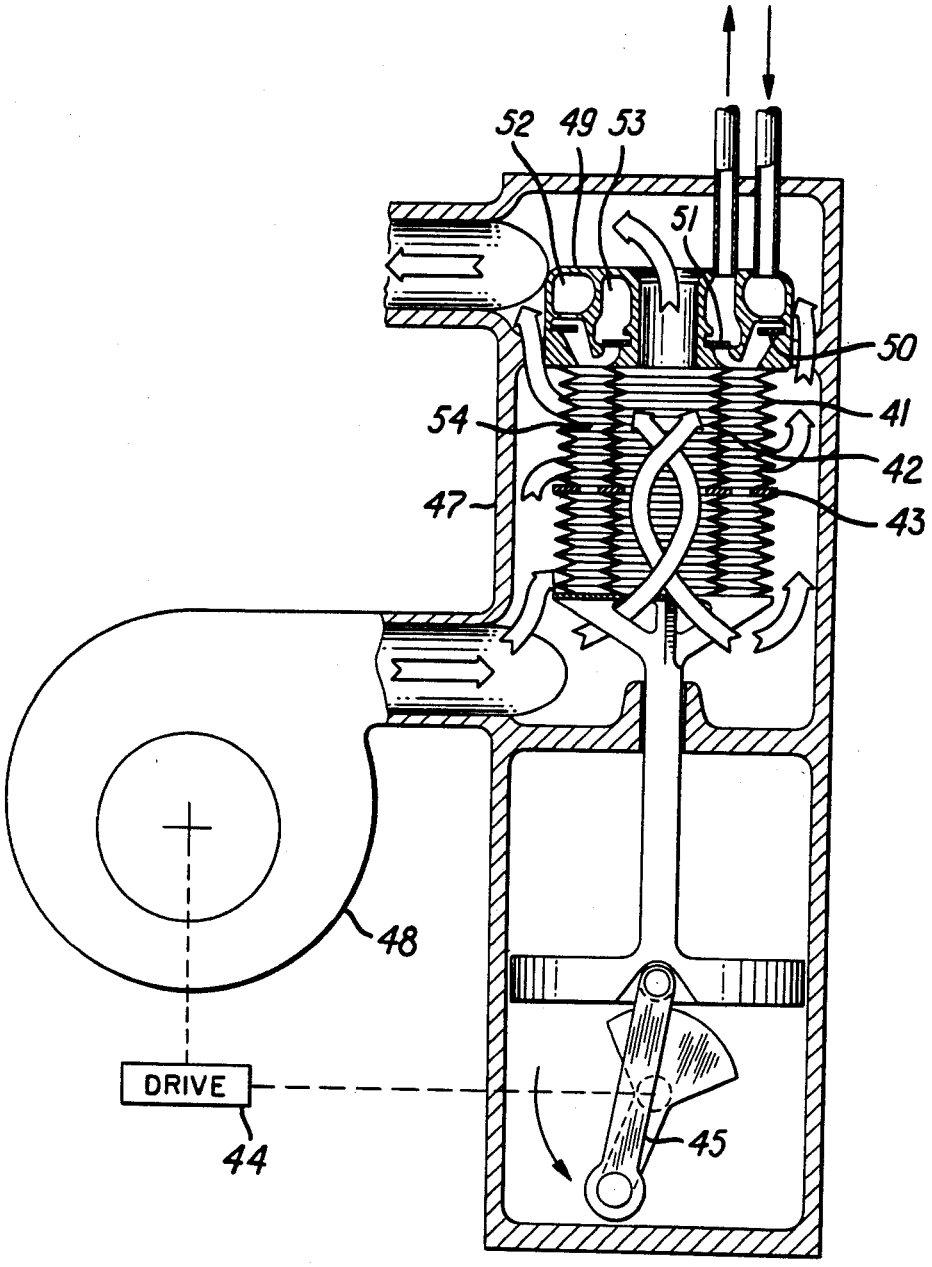
FIG. 14 is a side cross-sectional view in generally schematic form of an isothermal air compressor embodying the present invention.

Referring to FIG. 14, the variable compression volume is the annular chamber between rippled nested bellows 41 and 42, with an optimal mid-plane separator plate 43. The bellows are driven by a drive 44 through a crank 45. A housing 47 surrounds the bellows for directing cooling air from a fan 48 around the bellows and through the hole within the inner bellows 42. A head 49 with inlet and outlet valves 50 and 51 connect to the suction and discharge plenums 52 and 53. In operation the nested bellows are alternately compressed and expanded by the action of the crank, and air is alternately inducted into the annular space 54 between the nested bellows, compressed and discharged through the duct and plenum 53 to a receiver, not shown. This compressor provides a higher efficiency isothermal cycle resulting from the high heat exchange of internal and external gases.

I claim:

1. Isothermal positive displacement machinery having a variable volume compression-expansion chamber defined in part by an outer round flexible metal bellows-like wall having a plurality of convolutions and in further part by an end wall that is adapted to reciprocate along the axis of the outer bellows-like wall characterized in that the convolutions of the outer wall are joined in close axial spacing along inner and outer circular boundaries, the inner boundary of each convolution of the outer wall has a diameter of from about one-third to about one-tenth that of the outer boundary, and the inner boundaries of the convolutions define a zone connecting the small volumes defined between adjacent convolutions, the zone being small and in close diffusive thermal contact with the bellows-like wall to ensure that the working gas remains isothermal throughout each cycle, that during each stroke numerous heat exchanges occur between the working gas in the chamber and the bellows-like wall by both laminar and turbulent heat transfer and that heat is conducted to and through the bellows-like wall and to and from a thermal reservoir externally of the bellow-like wall.

2. Isothermal positive displacement machinery according to claim 1 and further characterized in that there is an inner round flexible metal bellows-like wall nested within the outer wall and defining an annular chamber, the inner wall has a plurality of convolutions joined in close axial spacing along inner and outer circular boundaries, and the nearer boundaries of the inner and outer walls are closely spaced radially and define as annular zone connecting the small volumes between adjacent convolutions of both the inner and outer walls such that the chamber is substantially free of trapped volumes that are not in close diffusive turbulent thermal contact with one of the bellows-like walls, thereby ensuring that the working gas remains isothermal throughout the cycle.

3. Isothermal positive displacement machinery according to claim 1 in which the chamber is defined transversely solely by the outer wall and further characterized in that the diameter of the inner boundary is from about one-fifth to about one-tenth of the diameter of the outer boundary.

4. Isothermal positive displacement machinery according to claim 1 in which the chamber is defined transversely solely by the outer wall and further characterized in that the diameter of the inner boundary is from about one-third to about two-thirds of the diameter of the outer boundary, and a metal baffle is connected to the bellows-like outer wall within each convolution, each baffle having holes to cause circulation of the working gas within the chamber for enhancement of the heat transfer between the gas and the baffles and bellows-like wall.

5. Isothermal positive displacement machinery according to any of claims 1 to 4 and further characterized in that each bellows-like wall comprises annular discs joined and sealed at each inner and outer boundary to an adjacent disc.

6. Isothermal positive displacement machinery according to any of claims 1 to 3 and further characterized in that a fluid is caused to flow through said external thermal reservoir and over the surface of the bellows-like wall externally of the chamber for enhancement of the heat transfer from the working gas to and through the bellows-like walls.

7. Isothermal positive displacement machinery according to any of claims 1 to 3 and further characterized in that the configurations of the bellows-like wall convolutions are such that no working gas in the chamber is ever farther than 10 mm. from a bellows-like wall surface.

8. Isothermal positive displacement machinery according to claim 4 and further characterized in that the configurations of the bellows-like wall convolutions and the baffles are such that no working gas in the chamber is ever farther than 10 mm. from a wall or baffle surface.

9. Isothermal positive displacement machinery according to claim 5 and further characterized in that each disc of the bellows-like walls has not less than five ripples for reduced wall stress and enhancement of heat transfer between the working gas and said walls.

10. Isothermal positive displacement machinery according to any of claims 1 to 3 and further characterized in that the ratio of the surface area of the bellows-like or walls to the surface area of a right circular cylinder of equivalent volume is not less than about 10:1.

11. Isothermal positive displacement machinery according to claim 4 and further characterized in that the ratio of the total surface area of the bellows-like walls and the baffles to the surface area of a right circular cylinder of equivalent volume is not less than about 10:1.

12. Isothermal positive displacement machinery according to any of claims 1 to 4 and further characterized in that the heat mass of the thermal skin depth of each bellows-like wall is not less than about 100 times the heat mass of the working gas.

13. Isothermal positive displacement machinery according to any of claims 1 to 4 and further characterized in that the compression ratio of the machinery is of the order of from 2.0:1 to 2.7:1.

14. Isothermal positive displacement machinery according to any of claims 1 to 4, the machinery having a Stirling cycle unit composed of a compression chamber and an expansion chamber as claimed in any of claims 1 to 4, the chambers being closely coupled to each other for gas transfer by a regenerator positioned between them and having movable end walls driven harmonically at a phase relationship of from about 90° to 120°, and characterized in that the lengths, areas and shapes of the gas flow paths of the regenerators are such that the gas flow friction loss of the regenerator does not exceed about 3%.

15. Isothermal positive displacement machinery according to claim 14 and further characterized in that the dead volume of the regenerator and all connecting volumes between the chambers and the regenerator are less than about 10% of the displacement volume of the unit.

16. Isothermal positive displacement machinery according to claim 14 and further characterized in that the regenerator is designed to have from about 5 to about 10 heat exchange lengths.

17. Isothermal positive displacement machinery according to claim 14 and further characterized in that the heat mass of the metal of the regenerator is of the order of 10 to 20 times the heat mass of the working gas.

18. Isothermal positive displacement machinery according to claim 14 and further characterized in that the movable end walls of the chambers are driven by a free piston positive displacement engine that operates on an Otto or diesel cycle.

19. Isothermal positive displacement machinery according to claim 14 and further characterized in that the movable end walls of the chambers are driven by a linear electric motor.

20. Isothermal positive displacement machinery according to claim 14 and further characterized in that there is a second Stirling cycle unit composed of a compression chamber and an expansion chamber, each having a bellows-like peripheral wall and being closely coupled to each other for gas transfer by a regenerator positioned between them, the expansion chambers and the compression chambers, respectively, of the two units being mechanically interconnected to move conjointly.

21. Isothermal positive displacement machinery according to claim 14 and further characterized in that there is a Stirling cycle engine composed of a compression chamber and an expansion chamber as claimed in any of claims 1 to 4 closely coupled to each other for gas transfer by a regenerator positioned between them, and the expansion chambers and the compression chambers, respectively, of the unit and the engine being mechanically coupled to move conjointly, and in that there is means for supplying a flow of a hot gas to the thermal reservoir of the expansion chamber of the engine.

22. Isothermal positive displacement machinery according to claim 14 and further characterized in that there is means for supplying a flow of hot gas to the thermal reservoir of the expansion chamber, whereby the unit is a Stirling cycle engine.

23. Isothermal positive displacement machinery according to any of claims 1 to 4 and further characterized in that there is means for driving one end wall of the chamber, and in that the other end wall of the chamber has valved supply and exhaust ports for admitting and releasing gas to and from the chamber whereby the machinery is a compressor.

24. Isothermal positive displacement machinery according to claim 5 and further characterized in that each disc is joined and sealed by an elastomer adhesive at its inner and outer boundary to an adjacent disc.

25. Isothermal positive displacement machinery according to claim 24 and further characterized in that pairs of adjacent discs are joined at their outer boundaries by crimped channels.

* * * * *

UNITED STATES PATENT AND TRADEMARK OFFICE

CERTIFICATE OF CORRECTION

PATENT NO. : 4,490,974

DATED : January 1, 1985

INVENTOR(S) : Stirling A. Colgate

It is certified that error appears in the above-identified patent and that said Letters Patent is hereby corrected as shown below:

Column 3, line 65, "along" should be --alone--; Column 5, line 42, after "in" insert --the--; Column 11, line 52, after "small" insert --, i.e., --; Column 15, line 39, "1800" should be --1/800--; Column 15, line 43, after "second," insert --or--; Column 26, line 13, "as" should be --an--; and Column 27, line 3, after "bellows-like" insert --wall--.

Signed and Sealed this

*Twenty-eighth* Day of *May 1985*

[SEAL]

*Attest:*

DONALD J. QUIGG

*Attesting Officer* *Acting Commissioner of Patents and Trademarks*